US009346051B2

(12) United States Patent
Momose

(10) Patent No.: US 9,346,051 B2
(45) Date of Patent: May 24, 2016

(54) MICROCHIP

(71) Applicant: Rohm Co., Ltd., Kyoto (JP)

(72) Inventor: Shun Momose, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 135 days.

(21) Appl. No.: 14/138,513

(22) Filed: Dec. 23, 2013

(65) Prior Publication Data

US 2014/0186214 A1 Jul. 3, 2014

(30) Foreign Application Priority Data

Dec. 27, 2012 (JP) ..... 2012-285111
Jan. 8, 2013 (JP) ..... 2013-001129

(51) Int. Cl.
*B01L 3/00* (2006.01)

(52) U.S. Cl.
CPC ..... *B01L 3/502753* (2013.01); *B01L 3/502738* (2013.01); *B01L 3/502746* (2013.01); *B01L 2200/0621* (2013.01); *B01L 2300/087* (2013.01); *B01L 2300/0816* (2013.01); *B01L 2300/0864* (2013.01); *B01L 2300/0867* (2013.01); *B01L 2400/0406* (2013.01); *B01L 2400/0409* (2013.01); *B01L 2400/0688* (2013.01); *B01L 2400/086* (2013.01); *B01L 2400/088* (2013.01)

(58) Field of Classification Search
CPC ..... B01L 3/502753; B01L 3/502738; B01L 3/502746; B01L 2200/0621; B01L 2300/0816; B01L 2300/0864; B01L 2300/087; B01L 2300/0867; B01L 2400/088; B01L 2400/0406; B01L 2400/0409; B01L 2400/0688; B01L 2400/086
See application file for complete search history.

(56) References Cited

U.S. PATENT DOCUMENTS

| | | | | |
|---|---|---|---|---|
| 2002/0176804 | A1* | 11/2002 | Strand et al. | 422/100 |
| 2004/0109793 | A1* | 6/2004 | McNeely et al. | 422/100 |
| 2007/0243111 | A1 | 10/2007 | Momose | |
| 2009/0098658 | A1 | 4/2009 | Momose et al. | |
| 2011/0207619 | A1* | 8/2011 | Ehben et al. | 506/9 |

FOREIGN PATENT DOCUMENTS

| | | |
|---|---|---|
| JP | 2007-285792 | 11/2007 |
| JP | 2009-109429 | 5/2009 |
| JP | 2009-133805 | 6/2009 |

* cited by examiner

*Primary Examiner* — Jill Warden
*Assistant Examiner* — Timothy G Kingan
(74) *Attorney, Agent, or Firm* — Fish & Richardson P.C.

(57) ABSTRACT

A microchip including a fluid circuit composed of a space formed inside is provided. The space includes a first space, a second space, and a space connecting portion connecting the first space and the second space, and the space connecting portion has a structure portion restraining liquid moving between the first space and the second space from moving due to wettability with respect to the space connecting portion surface.

16 Claims, 11 Drawing Sheets

MICROCHIP

BACKGROUND OF THE INVENTION

1. Field of the Invention

The present invention relates to a microchip having an internal fluid circuit therein suitably used for biochemical test, chemical synthesis, environmental analysis, and the like.

2. Description of the Background Art

In recent years, in the fields of medical care, health, food, drug discovery, and the like, detection or quantitation of biological substances such as DNA, enzyme, antigen, antibody, protein, virus, or cell as well as chemical substances has become increasingly important, and various biochips and micro chemical chips (such chips will hereinafter be collectively referred to as "microchip") with which the above-described substances can be easily and conveniently measured have been proposed.

The microchip can be used to allow a series of experimental and analytical operations, which are conventionally performed in a laboratory, to be conducted within the small chip. The microchip accordingly provides many advantages that the amounts of samples and liquid reagents to be used are very small, the cost is low, the reaction rate is high, high throughput test or analysis can be conducted, and the test or analysis results can be immediately obtained at the site where the sample was extracted, for example.

A conventionally known microchip includes a fluid path network, called a "fluid circuit" (or "micro fluid circuit"), which is constituted of several kinds of parts (chambers) for performing particular treatments on liquid such as a sample or a liquid reagent present in the circuit, and flow paths connecting these parts (for example, Japanese Patent Laying-Open Nos. 2007-285792, 2009-133805, and 2009-109429).

SUMMARY OF THE INVENTION

In test or analysis of a sample using the microchip having such internal fluid circuit, the fluid circuit is used to perform various treatments including discharging of a liquid reagent from a liquid reagent retaining portion accommodating the liquid reagent to be mixed with a sample (or a specific component in the sample) introduced in the liquid fluid circuit, measurement of the sample (or a specific component in the sample) or the liquid reagent (that is, transfer to a measuring portion that is a part for performing measurement), mixing of the sample (or a specific component in the sample) with the liquid reagent (that is, transfer to a mixing portion that is a part for mixing the sample with the liquid reagent), and transfer from one part to another part.

It is noted that treatments of various liquids (such as a sample, a specific component in the sample, a liquid reagent, or a mixture of two or more kinds thereof) performed in the microchip will hereinafter sometimes be referred to as "fluid treatment". These various fluid treatments can be performed by applying centrifugal force in an appropriate direction to the microchip.

To obtain reliable test or analysis result reproducibly in the test or analysis performing fluid treatment by applying centrifugal force to the microchip to move various liquids in the fluid circuit to a predetermined part, appropriate fluid treatment must be performed when centrifugal force in a predetermined direction is applied. For this purpose, it must be ensured that liquid in the fluid circuit moves to a direction as designed (intended) when the centrifugal force in the predetermined direction is applied.

However, in the fluid treatments, liquid sometimes moved in an unintended direction that is different from the direction of applying the centrifugal force due to wettability of the liquid with respect to an inner surface of the fluid circuit. For example, in the conventional microchips, for example, when attempting to move liquid from a region A to a region B in the fluid circuit by applying centrifugal force in a first direction and thereafter move the liquid from region B to a region C by applying centrifugal force in a second direction that is different from the first direction, a phenomenon (reverse flow) sometimes occurred in which the liquid does not move to C but returns to region A by the centrifugal force in the second direction depending on a kind of the liquid.

A typical example causing such problem described above includes the case where the microchip is for use in blood test and the liquid subjected to the fluid treatment is a plasma component or the like. In the case where the liquid contains a component (protein or the like) that adheres to an inner wall surface of the fluid circuit such as a plasma component or the like, moving the liquid from region A to region B causes a small amount of the component described above to adhere to and remain on the moving route. In such a state, when it is attempted to move the plasma component from region B to region C by applying centrifugal force in the second direction, since a plasma component has higher wettability to the component than to the inner wall surface of the fluid circuit, the blood plasma sometimes flows reversely in the direction to region A along the route on which the component adheres, against the restriction on the moving direction by the centrifugal force.

Further, the test or analysis of a sample using the conventional microchip had the following problem. The problem will be described with reference to FIG. 21. FIG. 21 is a top view representing a fluid circuit structure of a conventional microchip 500. Microchip 500 is constituted of a first substrate having on a surface thereof a groove (groove pattern) forming a fluid circuit, and a second substrate stacked on and laminated with the groove-formed surface of the first substrate. Although the fluid circuit is constituted of space formed in microchip 500, FIG. 21 shows the fluid circuit structure with solid lines so that the fluid circuit structure can be clearly understood.

A method of test or analysis of a sample using the microchip will be briefly described as follows with reference to an exemplary case in which a sample is whole blood, and a plasma component is extracted from the whole blood in the fluid circuit, and test or analysis of the plasma component is performed. Firstly, a sample tube containing collected whole blood is inserted to a sample tube mounting portion 501. Next, centrifugal force is applied in the leftward direction in FIG. 21 (hereinafter, simply referred to as "leftward", and this also applies to other directions) to microchip 500 to extract whole blood from the sample tube. After that, the whole blood is introduced into a separation portion 502 by downward centrifugal force, and centrifugal separation is performed, so that the whole blood is separated into a plasma component and a blood cell component. When the whole blood is introduced into separation portion 502, whole blood overflew therefrom is stored in overflow liquid storage 515. Further, this downward centrifugal force allows a liquid reagent S1 in a liquid reagent retaining portion 504 to be introduced into a liquid reagent measuring portion 506, and measurement is performed. When liquid reagent S1 is introduced into liquid reagent measuring portion 506, liquid reagent S1 overflew therefrom is stored in overflow liquid storage 515.

Reference numerals 513 and 514 in FIG. 21 respectively denote reagent inlets for injecting a liquid reagent into liquid reagent retaining portions 504, 505.

Next, the separated plasma component is introduced into a sample measuring portion 503 by rightward centrifugal force, and measurement is performed. When the plasma component is introduced into sample measuring portion 503, a plasma component overflew therefrom is stored in an overflow liquid storage 516. Further, this rightward centrifugal force allows liquid reagent S1 measured in liquid reagent measuring portion 506 to be moved to mixing portion 509, and allows a liquid reagent S2 in liquid reagent retaining portion 505 to be discharged from an outlet thereof.

Next, the measured plasma component and the measured liquid reagent S1 are mixed in a mixing portion 508 by downward centrifugal force. Further, liquid reagent S2 is measured in liquid reagent measuring portion 507 by this downward centrifugal force. Then, rightward, downward, and rightward centrifugal forces are sequentially applied to allow mixed liquid to come and go between mixing portions 508 and 509 to perform sufficient mixing of the mixed liquid.

Next, the mixed liquid constituted of liquid reagent S1 and the plasma component is mixed with measured liquid reagent S2 by upward centrifugal force in a mixing portion 510. Then, leftward, upward, leftward, and upward centrifugal forces are sequentially applied to allow the mixed liquid to come and go between mixing portions 510 and 511 to perform sufficient mixing of the mixed liquid. Finally, the mixed liquid in mixing portion 510 is introduced into a detection portion 512 by rightward centrifugal force. The mixed liquid in detection portion 512 is subjected to optical measurement of irradiating light to detection portion 512 and measuring the intensity of transmitted light.

The example of the fluid treatment described above is an example of the case of extracting the plasma component from the whole blood in the fluid circuit and performing test or analysis of the plasma component. In some cases, a plasma component and a liquid reagent are not mixed, and instead serum prepared in advance is introduced into a fluid circuit, and the same items are tested. In such cases, the conventional microchip such as microchip 500 exhibited different measurement results between the case of using the plasma component and the case of using serum as an object to be tested.

The present invention was achieved in view of the problems described above, and its object is to provide a microchip capable of preventing movement of the liquid in the fluid circuit in an unintended direction due to wettability of the liquid with respect to an inner surface of the fluid circuit, such as the reverse flow phenomenon to assuredly perform a desirable fluid treatment as designed, and thereby reproducibly obtaining reliable test or analysis result.

Further, another object of the present invention is to provide a microchip capable of preventing fluctuation in test results due to difference in kinds of samples to exhibit improved test or analysis accuracy.

As means for achieving the objects described above, the present invention provides the following microchip. As to the another object, the inventors found out that the cause of fluctuation in the test results as described above which occurs due to difference in a kind of sample is attributed to the fact that when liquid is introduced into a measuring portion by applying centrifugal force to the microchip, and the liquid is measured, a part of the measured liquid in the measuring portion moves along the side surfaces of the groove forming the fluid circuit and flows out, due to tensional force caused by its wettability, so that the liquid is measured with a slightly smaller amount than the amount that should be measured at the measuring portion, and the fact that the amount of liquid flowing out of the measuring portion depends on a kind of a sample. Then, the inventors conducted various studies to resolve the reason and completed the present invention.

[1] A microchip comprising a fluid circuit composed of a space formed inside, said space including a first space, a second space, and a space connecting portion connecting the first space and the second space, and said space connecting portion having a structure portion for restraining liquid moving between the first space and the second space from moving due to wettability of the liquid with respect to a surface of said space connecting portion.

[2] The microchip according to [1], further comprising a first substrate having on a surface thereof a groove forming said space, and a second substrate stacked on a surface of said first substrate on a side having said groove, wherein said groove of said first substrate includes a first groove forming said first space, a second groove forming said second space, and a third groove forming said space connecting portion, and said third groove is a groove coupling the first groove and the second groove, and has a larger base area than said first groove and said second groove, and said second substrate has a recess as said structure portion on a surface on the side of said first substrate and at a position facing said third groove.

[3] The microchip according to [2], further comprising a protrusion protruding from a side wall surface of said recess on a side of said first groove and having a protrusion length such that an end portion of said protrusion does not come in contact with an opposite side wall surface.

[4] The microchip according to [2] or [3], wherein a base area of said recess is smaller than a base area of said third groove.

[5] The microchip according to [4], wherein said recess is arranged so as to be within a surface region of said second substrate facing a surface region of said first substrate in which said third groove is formed.

[6] The microchip according to any of [3] to [5], wherein said protrusion is arranged such that a surface of said protrusion on a side of said first substrate continues with a surface of said second substrate.

[7] The microchip according to any of [3] to [6], wherein said protrusion has a shape which is tapered toward said end portion.

[8] The microchip according to any of [2] to [7], wherein said first groove, said second groove, and said third groove are aligned linearly.

[9] The microchip according to any of [2] to [8], wherein said second groove is a groove forming a measuring portion for measuring a sample.

[10] The microchip according to any of [2] to [9], wherein said groove of said first substrate further includes a fourth groove coupled to said third groove at a position different from the position at which said first groove and said second groove are coupled.

[11] The microchip according to [1], wherein said fluid circuit includes:

a measuring portion for measuring liquid, said measuring portion being said first space partitioned by a first wall; and a liquid introducing portion spatially connected with said measuring portion, said liquid introducing portion being said second space partitioned by a second wall, and said structure portion is a structure in which an end of said second wall on a side of said first wall is spaced apart from said first wall.

[12] The microchip according to [11], wherein said fluid circuit further includes an overflow liquid storage for storing excessive liquid flowing out from said measuring portion when said liquid is introduced into said measuring portion, said overflow liquid storage being composed of a third space partitioned by a third wall and being spatially connected to said measuring portion, and said third wall is spaced apart from said first wall.

[13] The microchip according to [12], further comprising:

a first substrate having grooves on both of opposite surfaces, a second substrate stacked on one surface of said first substrate, and a third substrate stacked on other surface of said first substrate, wherein said fluid circuit is composed of a first fluid circuit formed by the groove of said first substrate and a surface of said second substrate on a side of said first substrate, and a second fluid circuit formed by the groove of said first substrate and a surface of said third substrate on a side of said first substrate, and said first fluid circuit includes said measuring portion, and said second fluid circuit includes said overflow liquid storage portion, and a through hole penetrating through said first substrate in a thickness direction is formed in a groove bottom surface forming said measuring portion.

[14] The microchip according to [11] or [12], further comprising a first substrate having a groove on a surface thereof, and a second substrate stacked on the surface of said first substrate on a side having said groove, wherein said fluid circuit is composed of a space formed by the groove of said first substrate and a surface of said second substrate on a side of said first substrate.

[15] The microchip according to [12], further comprising a first substrate having grooves on both of opposite surfaces thereof, a second substrate stacked on one surface of said first substrate, and a third substrate stacked on other surface of said first substrate, wherein said fluid circuit is composed of a first fluid circuit formed by the groove of said first substrate and a surface of said second substrate on a side of said first substrate, and a second fluid circuit formed by the groove of said first substrate and a surface of said third substrate on a side of said first substrate, and said first fluid circuit includes said measuring portion and said overflow liquid storage.

[16] The microchip according to any of [11] to [15], wherein said first wall includes a first wall portion curved so as to have an opening for introducing said liquid, and a cross-sectional area of said first space in said opening is the smallest among cross-sectional areas of spaces surrounded by said first wall portion.

[17] The microchip according to any of [11] to [16], wherein said first wall includes:

a first wall portion curved so as to have an opening for introducing said liquid; and a second wall portion extending linearly outward from one end of said first wall portion.

[18] The microchip according to any of [11]-[17], wherein said second wall includes two linear walls arranged so as to face with each other.

[19] A microchip comprising a fluid circuit composed of a space formed inside, said microchip including a first substrate having on a surface thereof a groove forming said space, and a second substrate stacked on a surface of said first substrate on a side having said groove, and said groove of said first substrate including a first groove, a second groove, and a third groove, said third groove being a groove coupling said first groove and said second groove and having a base area larger than that of said first groove and said second groove, and said second substrate having a recess on a surface on a side of said first substrate and at a position facing said third groove.

[20] A microchip comprising a fluid circuit composed of a space formed inside, said fluid circuit including:

a measuring portion for measuring liquid, said measuring portion being composed of a first space partitioned by a first wall; and a liquid introducing portion spatially connected with said measuring portion, said liquid introducing portion being composed of a second space partitioned by a second wall, and an end of said second wall on a side of said first wall is spaced apart from said first wall.

According to the present invention, the recess is provided, so that movement of liquid in the fluid circuit in an unintended direction, as exemplified by the reverse flow phenomenon described above, can be prevented, and fluid treatment as intended by design can be assuredly performed. Thus, according to the present invention, a microchip capable of reproducibly obtaining highly reliable test or analysis result can be provided.

Further, according to the microchip of the present invention, unintended flowing out of measured liquid in the measuring portion based on tensional force due to wettability can be prevented regardless of a kind of a sample. Therefore, accurate measurement can be performed regardless of a kind of a sample. Thus, according to the microchip of the present invention, fluctuation of test or analysis result attributed to a kind of a sample can be prevented, and test or analysis accuracy can also be improved.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

<Overview of Microchip>

Figure 1:
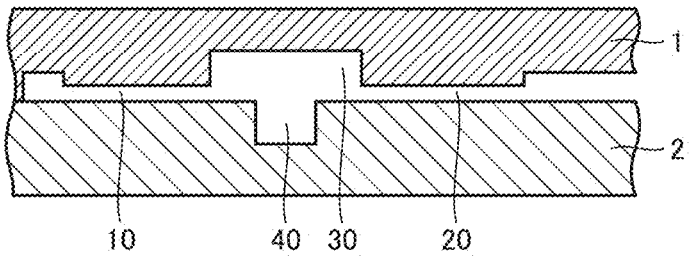
FIG. 1 is a cross-sectional view schematically representing one example of a microchip according to a first embodiment.

A microchip of the present invention is a chip with which various chemical synthesis, test or analysis is performed using a fluid circuit inside the microchip (a space formed inside). Appropriate fluid treatments can be performed for liquid in the fluid circuit (for example, a sample, a specific component in the sample, a reagent such as a liquid reagent, or a mixture of two or more kinds thereof) by transferring the liquid to a prescribed portion (chamber) in the fluid circuit by applying centrifugal force. For this purpose, the fluid circuit includes a variety of parts (chambers) arranged at appropriate positions, and these parts are appropriately connected through flow paths.

The "sample" refers to a specimen to be tested or analyzed which is introduced into the fluid circuit, or a specific component extracted therefrom. Further, the "liquid reagent" refers to a reagent to mixed or reacted with a sample, or a reagent for treatment of the sample. A liquid reagent is typically stored in advance in a liquid reagent retaining portion of the fluid circuit before testing or analyzing the sample with use of a microchip.

The parts (chambers) of the fluid circuit may include a liquid reagent retaining portion accommodating a liquid reagent; a separation portion for extracting a specific component from a sample introduced into the fluid circuit; a sample measuring portion for measuring the sample (in some cases, including a specific component in the sample, which is applicable in the following); a liquid reagent measuring portion for measuring a liquid reagent; a mixing portion for mixing a sample with a liquid reagent; a detection portion for performing test or analysis for the resultant liquid mixture (for example, detection or quantitation of a specific component in the liquid mixture); a flow rate restricting portion; a storage portion for temporarily accommodating specific liquid; a waste liquid storage portion for accommodating waste liquid (for example, an overflow liquid storage for accommodating excessive liquid overflew from the measuring portion when liquid is introduced into the measuring portion to perform measurement); and the like.

The flow rate restricting portion refers to a part including a flow path portion having a narrow flow path width (or having a small flow path cross-sectional area) provided to reduce a flow rate and a liquid width of liquid immediately before introduction to these parts so that liquid can be introduced into the measuring portion, the separation portion, or the like smoothly and without biting of air.

In general, the microchip has on one surface thereof a reagent inlet, which is a through hole for injecting a liquid reagent into the liquid reagent retaining portion, so as to reach the liquid reagent retaining portion. After the liquid reagent is injected, the reagent inlet is sealed by attaching a sealing layer (for example, a plastic film, a label, a seal, or the like having an adhesive layer on one surface) to the surface of the microchip. Further, the microchip has on a surface thereof a sample inlet (for example, including the sample tube mounting portion), which is a through hole for injecting a sample, so as to reach the fluid circuit (to be connected to the fluid circuit).

The method for testing or analyzing the liquid mixture introduced into the detection portion is not particularly limited. Examples may include optical measurements such as a method of applying light to the detection portion accommodating the liquid mixture and detecting the intensity of the transmitted light (transmission ratio), and a method of measuring an absorption spectrum for the liquid mixture retained in the detection portion.

The microchip of the present invention may have all the parts (chambers) illustrated above or may not have any one or more of those parts. The microchip may have a part other than the parts illustrated above. The number of parts is not particularly limited and may be one, two or more. The microchips according to some embodiments have at least a measuring portion, such as the sample measuring portion and the liquid reagent measuring portion, and an overflow liquid storage described above, and a liquid introducing portion described later.

Various fluid treatments in the fluid circuit, such as extraction of a specific component from a sample (separation of an unnecessary component), measurement of a sample and a liquid reagent, mixing of a sample with a liquid reagent, and introduction of the resultant liquid mixture to the detection portion, can be performed by successively applying centrifugal force in an appropriate direction to the microchip to successively transfer the target liquid to prescribed parts arranged at prescribed positions. For example, the measurement of a sample and a liquid reagent can be carried out by introducing the sample or the liquid reagent to be measured to the sample measuring portion or the liquid reagent measuring portion having predetermined capacities (the same capacity as the quantity to be measured) by applying centrifugal force, and allowing the excessive sample or liquid reagent to overflow from the sample measuring portion or liquid reagent measuring portion. The sample or liquid reagent that overflows can be accommodated in the waste liquid storage portion (overflow liquid storage) connected to the sample measuring portion or liquid reagent measuring portion.

Centrifugal force can be applied to the microchip by placing the microchip in a device capable of applying centrifugal force (centrifugal device). The centrifugal device can include a rotor (rotator) capable of rotating and a rotatable stage arranged on the rotor. The microchip is placed on the stage, and the stage is set at a given angle with respect to the rotor by rotating the stage, and the rotor is thereafter rotated. Thus, centrifugal force in a given direction can be applied to the microchip.

The microchip of the present invention can be configured to include a first substrate and a second substrate stacked on and laminated with the first substrate. For example, the microchip can be composed of a first substrate and a second substrate stacked on and laminated with the first substrate. In this case, a groove (pattern groove) forming the fluid circuit is provided on a surface of the first substrate (a surface on a side facing the second substrate), both substrates are laminated with each other while providing the groove inside, so that a fluid circuit as an internal space is constructed. In other words, the fluid circuit in the microchip of the present invention is composed of a bottom surface of the groove of the first substrate, and a space formed by a side wall surface of the wall forming the groove and the surface of the second substrate on the side of the first substrate (this similarly applies to the first and second fluid circuits of the microchip further including a third substrate which will be described later).

The microchip of the present invention may be formed by stacking and laminating a second substrate, a first substrate, and a third substrate in this order. In this case, grooves forming the fluid circuit are provided on both of opposite surfaces of the first substrate, and the microchip includes a two-layer fluid circuit including a first fluid circuit constructed by the first substrate and the second substrate and a second fluid circuit constructed by the first substrate and the third substrate. Here, "two-layer" means that fluid circuits are provided at different two positions with respect to the thickness direction of the microchip. The two-layer fluid circuit can be connected through one or more through holes penetrating through the first substrate in the thickness direction.

The method of laminating the substrates is not particularly limited, and examples thereof may include a method of fusing and welding the laminated surface of at least one of the substrates to be laminated (welding method) and a method of bonding using adhesive. Examples of the welding method may include a method of welding by heating the substrate, a method of applying light such as laser beams and welding by heat produced in light absorption (laser welding), and a method of welding by ultrasonic waves. Among those, the laser welding is preferably used.

The size of the microchip of the present invention is not particularly limited and, for example, may be about a few centimeters to ten centimeters in length and width and about a few millimeters to a few centimeters in thickness.

The material of each substrate that constitutes the microchip of the present invention is not particularly limited. Examples of the material may include thermoplastic resins such as polyethylene terephthalate (PET), polybutylene terephthalate (PBT), polymethylmethacrylate (PMMA), polycarbonate (PC), polystyrene (PS), polypropylene (PP), polyethylene (PE), polyethylene naphthalate (PEN), polyarylate (PAR) resin, acrylonitrile-butadiene-styrene (ABS) resin, polyvinyl chloride (PVC) resin, polymethylpentene (PMP) resin, polybutadiene (PBD) resin, biodegradable polymer (BP), cycloolefin polymer (COP), and polydimethylsiloxane (PDMS).

In the case where the microchip is configured with the first substrate and the second substrate, at least one of the substrates is preferably a transparent substrate in order to construct a detection portion for optical measurement using detection light. The other substrate may be either a transparent substrate or an opaque substrate. When laser welding is performed, an opaque substrate is preferred since the optical absorption ratio can be increased. More preferably, a black substrate is preferred which is obtained by forming the substrate with the thermoplastic resin and adding black pigment such as carbon black in the thermoplastic resin.

In the case where the microchip is configured with the second substrate, the first substrate, and the third substrate, the first substrate is preferably an opaque substrate, more preferably a black substrate, from the viewpoint of efficiency of laser welding. On the other hand, the first and third substrates are preferably transparent substrates on the same reason as described above.

The method of forming a groove (pattern groove) constituting the fluid circuit on the first substrate and a recess to be formed on the second substrate in the microchip according to some embodiments is not particularly limited. Examples of the method may include an injection molding method using a mold having a transfer structure, an imprint method, and a cutting method. The shape and pattern of the groove is determined so that the structure in the internal space has an appropriate fluid circuit structure.

<Embodiment of the Microchip of the Present Invention>

In microchips according to some embodiments of the present invention, with a microchip having the configuration as schematically described in the section of <Overview of Microchip>, a recess is formed on a surface of a second substrate on a side of a first substrate so as to face a groove (may be two or more grooves) located at a specified position among a plurality of grooves of the first substrate constituting a fluid circuit composed of an internal space. This recess is a structure portion for suppressing movement of liquid in an unintended direction due to wettability of the liquid with respect to an inner surface of the fluid circuit (a surface of a space connecting portion described later) in fluid treatments. In other words, when liquid is moved so as to pass though above (to go over) the recess (when the microchip is used with the second substrate as an upper side, it goes "under the recess") from a region A to a region B in the fluid circuit by centrifugal force in a first direction (this moving route of the liquid is referred to as "first route"), and thereafter this liquid is moved from region B to a region C by applying centrifugal force in a second direction that is different from the first direction (this moving route of the liquid is referred to as "second route"), this recess prevents reverse flow of the liquid in the direction of region A along the first route against the restriction of the moving direction by the centrifugal force in the second direction, and allows the liquid to move to region C along the second route following the restriction of the moving direction. Here, "region" refers to a space constituting a part of the fluid circuit, and specifically refers to parts (chambers) constituting the fluid circuit or flow paths connecting these parts.

As described above, the reverse flow phenomenon occurs, for example, in the case where liquid to be moved passes through the first route so that a component raising wettability of the liquid (protein and the like) adheres to and remains on the first route, and force of restricting the moving direction of the liquid based on this high wettability becomes higher than the force of restricting the moving direction by the centrifugal force in the second direction. According to the microchip of the present invention, the liquid goes over the recess on the first route, and the region with adhesion of the component formed along the first route is divided by the recess. Therefore, even in the case of handling liquid containing a component raising the wettability of the liquid to be moved, reverse flow along the first route can be prevented, so that the liquid can be moved along the second route following the restriction of the moving direction by the centrifugal force in the second direction.

The recess is provided at a space connecting portion connecting one space (region) with another one space (region). Specifically, the recess is provided in a region where the force of restricting the moving direction of the liquid based on high wettability may be higher than the force of restricting the moving direction by the centrifugal force in the second direction. Such region is typically a region having a relatively large area where both a part of the first route and a part of the second route move across (also referred to as "region D", and regions A to D are regions located at different positions respectively), and a region where the liquid to be moved may flow reversely on the first route without taking the desirable second route following the application of the centrifugal force in the second direction depending on the magnitude of the force of restricting the moving direction of the liquid based on high wettability. In a region like a narrow flow path, the direction of the flow path itself restricts the direction of flow of the liquid. Therefore, it is not necessary to form a recess in such region in many cases.

Particularly, according to the present invention, a recess is provided in a region D of a microchip having a fluid circuit structure in which two regions, specifically, a region A (first space) and a region B (second space) having a relatively small area are connected through region D (space connecting portion) having a relatively large area as described above, and more typically, a recess is provided in region D having a fluid circuit structure further including a region C coupled to region D at a position different from the positions at which regions A and B are coupled (the first route is in the order of region A, region D, and region B, and the second route is in the order of region B, region D, and region C).

Hereinafter, the microchip of the present invention will be described more in detail with reference to embodiments.

(1) First Embodiment

FIG. 1 is a cross-sectional view schematically representing one example of a microchip according to the present embodiment. The microchip shown in FIG. 1 is composed of a first substrate 1, which is a transparent substrate, and a second substrate 2 stacked on and laminated with first substrate 1. A surface of first substrate 1 on a side facing second substrate 2 is provided with a plurality of grooves forming a fluid circuit, and the plurality of grooves include a first groove 10 forming a first space, a second groove 20 forming a second space, and a third groove 30 coupling first groove 10 with second groove 20 (laying between first groove 10 and second groove 20). This third groove 30 is a groove forming a space connecting portion.

First groove 10, second groove 20, and third groove 30 are aligned approximately linearly. Although not explicitly shown in FIG. 1, a base area of third groove 30 is larger than base areas of first groove 10 and second groove 20, and a space (region) configured with this third groove 30 corresponds to region D (space connecting portion) described above. Further, spaces (regions) configured with first groove 10 and second groove 20 correspond respectively to region A (first space) and region B (second space) described above. Thus, the first route is in the order of first groove 10, third groove 30, and second groove 20. Second substrate 2 has a recess 40 in a surface on a side of first substrate 1 and at a position facing third groove 30 corresponding to region D.

In FIG. 1, third groove 30 is a groove deeper than first groove 10 and second groove, but is not limited to this depth. The relationship in the depths of the grooves may be suitably set (this applies similarly to FIGS. 2 to 4 and FIGS. 7 to 8).

The microchip according to the present embodiment is, though not particularly limited, can be, for example, a microchip for blood test, particularly a microchip extracting a plasma component from whole blood and performing test or analysis of the plasma component. In this case, liquid moving so as to pass through above recess 40 from region A configured with first groove 10 to region B configured with second groove 20 (moving along the first route) by the centrifugal force in the first direction can be the plasma component. Separation and extraction of the plasma component from the whole blood can be performed by centrifugal separation at a separation portion arranged on upstream from first groove 10. However, the liquid is not limited to the plasma component, and may be other liquid containing a component raising the wettability of the liquid to be moved. For example, the liquid may be a surfactant.

When liquid such as a plasma component containing a component (such as protein), which adheres to an inner wall surface of the fluid circuit and raises the wettability of the liquid to be moved plasma component, moves on the first route by the centrifugal force in the first direction, the component adheres on the first route, and it causes the reverse flow, as described above. In the microchip according to the present embodiment, recess 40 is provided at a position facing third groove 30 on the first route to prevent this reverse flow. The liquid such as plasma component passing through the first route moves from the side of first groove 10 to the side of second groove 20 over recess 40. Thus, the adhesion region of the component formed along the first route is divided by recess 40. Even when force of restricting moving direction of liquid based on high wettability is applied, such division of the adhesion region prevents returning of the liquid to the side of first groove 10 by the force.

In FIG. 1, the second route (in the order of region B, region D, and region C) is not explicitly illustrated. However, a fourth groove coupled to third groove 30 at a position different from the position at which first groove 10 and second groove 20 are coupled (for example, front side or rear side in FIG. 1) is provided to have a second route in the order of second groove 20, third groove 30, and the fourth groove. The space (region) configured with the fourth groove corresponds to region C described above. When centrifugal force in the second direction is applied, even if the force of restricting the moving direction of the liquid based on the high wettability is higher than force of restricting the moving direction by the centrifugal force in the second direction in an initial stage, division of the adhesion region prohibits returning of the liquid to the side of first groove 10, and the liquid having reached recess 40 by the centrifugal force in the second direction moves along the second route following the restriction of the moving direction by the centrifugal force in the second direction.

In more specific example of the microchip according to the present embodiment, region A (first space) configured with first groove 10 can be parts (chambers) such as a flow path (fine flow paths and the like) connected to region D (space connecting portion) configured with third groove 30 and a flow rate restricting portion. Region B (second space) configured with second groove 20 can be parts (chambers) such as a flow path (fine flow path and the like) connected to region D configured with third groove 30 and a part (chamber) such as a sample measuring portion, a liquid reagent measuring portion, a separation portion, and the like. Region C configured with the fourth groove can be a flow path (a fine flow path and the like) connected to region D configured with third groove 30 and a part (chamber) such as a mixing portion.

Region D configured with third groove 30 arranges regions A to C at appropriate positions in the fluid circuit and can be a space or a flow path having an area larger than that of regions A to C required in view of designing to connect these regions appropriately. Typically, region D is a region in which both a part of the first route and a part of the second route go across.

The flow rate restricting portion is a part including a flow path portion having a narrow flow path width (or having a small flow path cross-sectional are) provided to reduce a flow rate and a liquid width of the liquid immediately before the liquid is introduced into parts such as the measuring portion and the separation portion so that the liquid can be introduced smoothly without biting of air.

Recess 40 is provided on the first route in region D (space connecting portion). The shape of recess 40 is not particularly limited, and its cross-sectional shape can be quadrilateral, such as a rectangle, a square, or the like. Specific examples of the shape of recess 40 include a recess formed of a cuboid shape, a cubic shape, or a shape having at least one rounded surface thereof. When recess 40 has a side wall surface on a side of second groove 20 extending in the direction of the second route, at the time of application of centrifugal force in the second direction, the liquid having reached recess 40 by the force of restricting moving direction of the liquid based on high wettability can be advantageously moved to the second route by the centrifugal force.

The size of recess 40 is not particularly limited, and it is all necessary to have a size capable of dividing the adhesion region for some extent of length, and its width (which is a distance from a side wall surface on a side of first groove 10 to a side wall surface on a side of second groove 20, and corresponds to a division length of the adhesion region) can be, for example, about 100 to 1000 μm. The depth of recess 40 is typically about 50 to 1000 μm.

As to the size of recess 40, a base area of recess 40 may be smaller or larger than, or as large as a base area of third groove 30 facing recess 40. However, it is preferable to set the base area of recess 40 to be smaller than the base area of third groove 30 and arrange recess 40 so as to be accommodated inside of a surface region Y of second substrate 2 facing a surface region X of first substrate 1 where third groove 30 is formed. To exert function (effect) of recess 40 described above, it is not particularly necessary to form recess 40 to have an area which is the same as or larger than third groove 30 having a relatively larger area.

Figure 2:
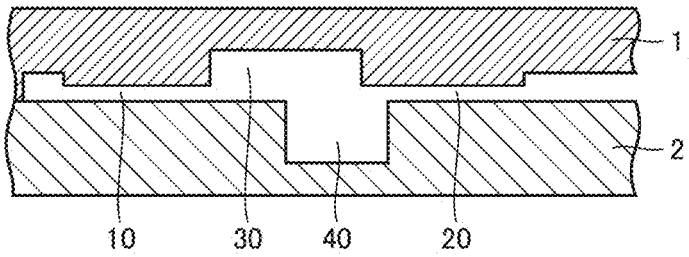
FIG. 2 is a cross-sectional view schematically representing another example of the microchip according to the first embodiment.
Figure 3:
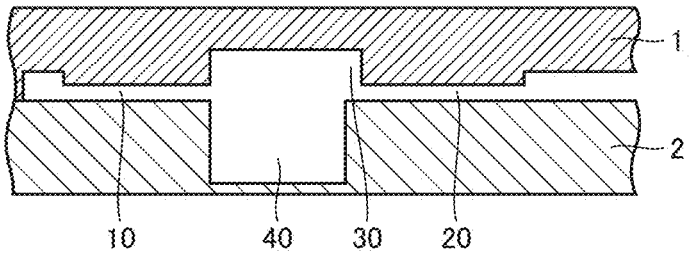
FIG. 3 is a cross-sectional view schematically representing yet another example of the microchip according to the first embodiment.
Figure 4:
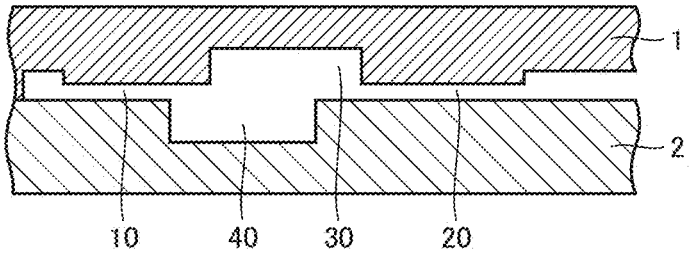
FIG. 4 is a cross-sectional view schematically representing yet another example of the microchip according to the first embodiment.

FIGS. 2 to 4 are cross-sectional views schematically representing another examples of the microchip according to the present embodiment. As illustrated in these drawings and FIG. 1, in the present invention, recess 40 is provided at a position facing third groove 30 on a surface of second substrate 2. This means that recess 40 is arranged such that at least a part of recess 40 is present in surface region Y of second substrate 2 facing surface region X of first substrate 1 where third groove 30 is formed.

FIGS. 2 and 4 represent forms in which the position of recess 40 is beyond the range of surface region Y described above. The present invention also includes such forms, and recess 40 exerts the function (effect) described above also in such forms. However, the depths (length in the thickness direction of the microchip) of first groove 10 and second groove 20 coupled to third groove 30 sometimes become larger. In such case, if region A and region B should be designed as flow paths having small depths (or a small cross-sectional areas), the forms shown in FIGS. 2 and 4 may sometimes be disadvantageous as compared to the example of FIG. 1.

FIG. 3 represents a form in which a position of one end of surface region X and a position of one end of surface region Y are aligned. The present invention also includes such form, and recess 40 exerts function (effect) described above also in such form. However, in the case where a positional displacement occurs at the time of laminating first substrate 1 with second substrate 2 in production of the microchip, and the position of recess 40 goes beyond the range of surface region Y as a result, it may be disadvantageous as compared to the example of FIG. 1, similarly to the forms illustrated in FIGS. 2 and 4.

Figure 5:
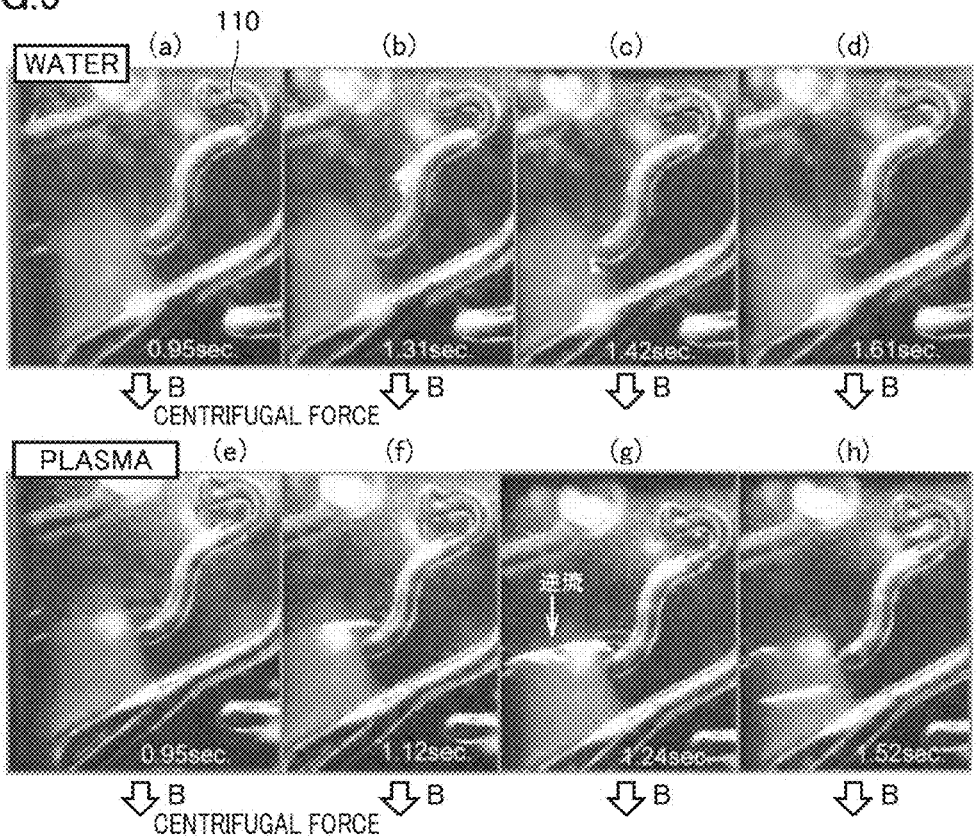
FIG. 5 represents pictures showing a moving route of liquid for the case where a microchip of a comparative example is used, and a perspective view showing enlargement of portions in the microchip provided with first to third grooves.
Figure 5:
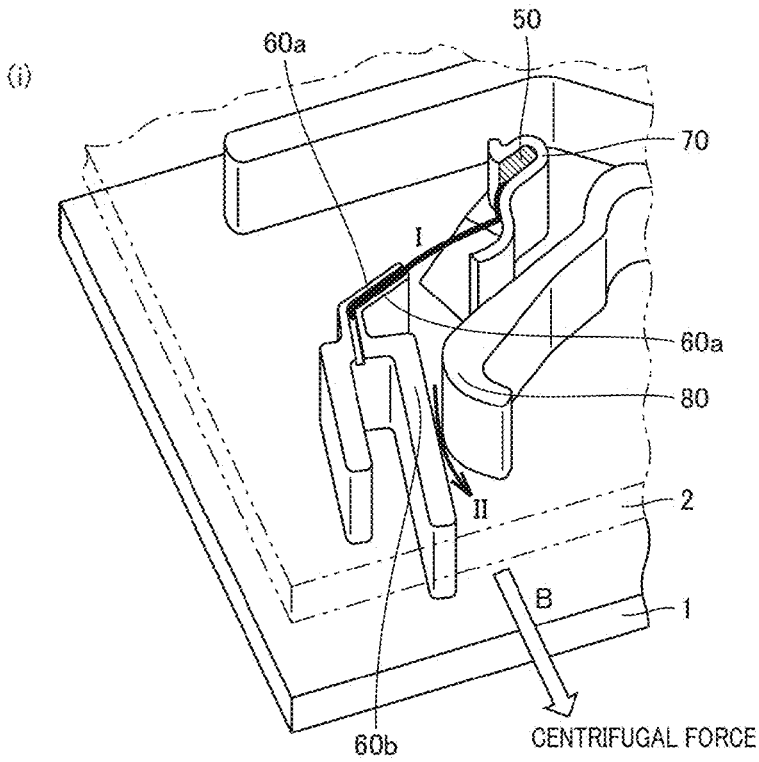
Figure 6:
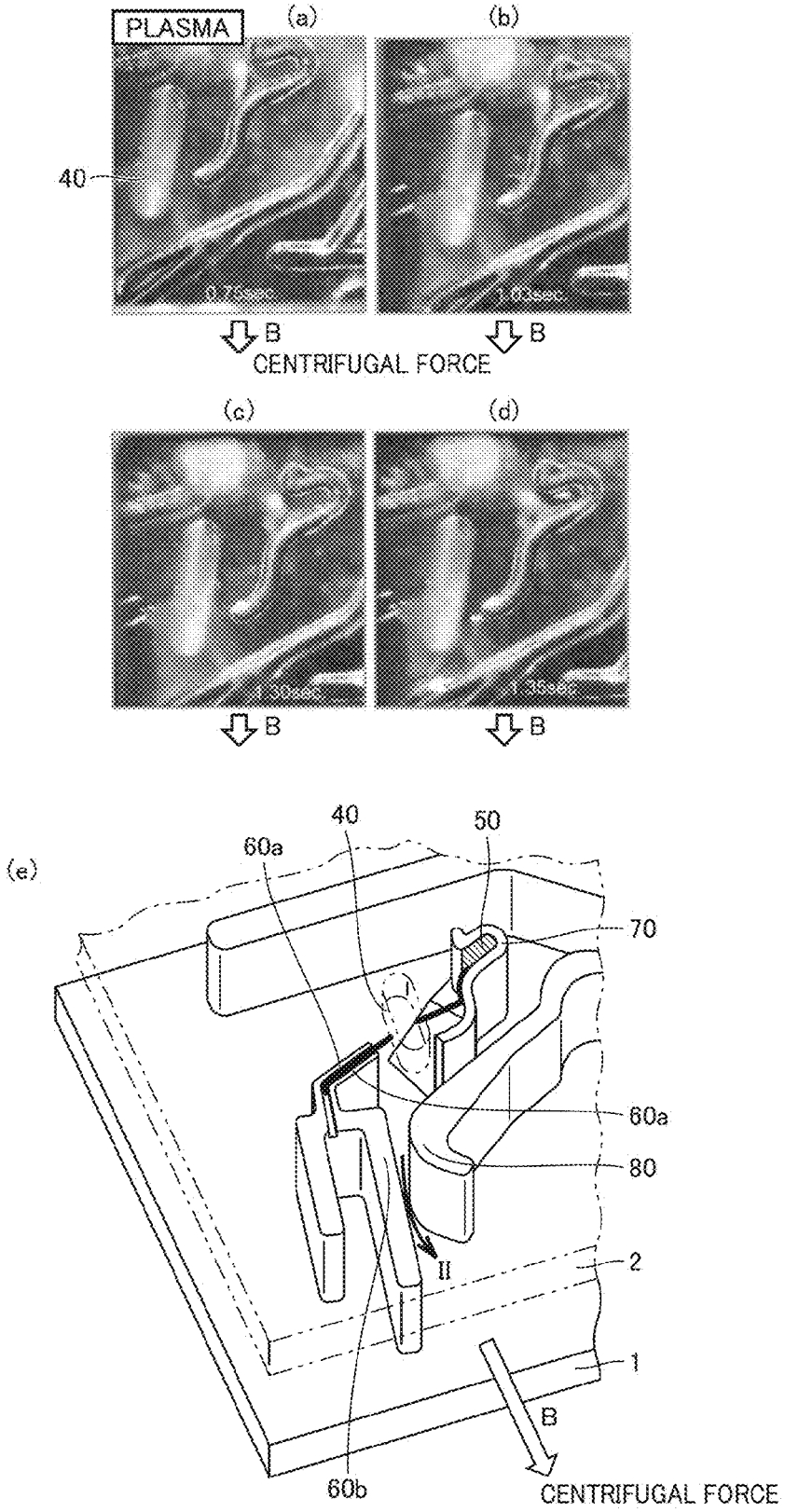
FIG. 6 represents pictures showing a moving route of liquid for the case where a microchip of an example according to the first embodiment is used, and a perspective view showing enlargement of portions in the microchip provided with first to third grooves.

Referring to FIGS. 5 and 6, the microchip according to the present embodiment will be described more in detail. FIG. 5 represents pictures (FIGS. 5(*a*) to 5(*h*)) showing a moving route of liquid for the case where a microchip of a comparative example (microchip having no recess) is used, and a perspective view (FIG. 5(*i*)) showing enlargement of portions in the microchip provided with first to fourth grooves.

FIGS. 5(*a*) to 5(*d*) are pictures referring to FIG. 5(*i*) temporally representing a moving route of liquid 50 at the time of application of centrifugal force in the second direction. In this case, water is used as liquid 50, and liquid 50 is moved by application of centrifugal force in the first direction from the flow rate restricting portion (first space) configured with fine first groove provided between two walls 60*a* to the sample measuring portion (second space) configured with the second groove surrounded by a wall 70 along a first route I. After that, measured liquid 50 is moved by application of centrifugal force in the second direction (direction of arrow indicated with B in FIGS. 5(*a*) to 5(*i*)) in the direction of the flow path configured with the fourth groove provided between walls 60*b* and a wall 80 along a second route II. The groove forming a region between the flow rate restricting portion and the sample measuring portion is a third groove (space connecting portion).

In the case where liquid 50 is water, the adhesion region along the first route caused by protein or the like as described above is not formed. Therefore, liquid 50 could be moved along the second route following the restriction of the moving direction by the centrifugal force in the second direction.

On the other hand, FIGS. 5(*e*) to 5(*h*) are pictures which are the same as FIGS. 5(*a*) to 5(*d*) other than that a plasma component instead of water is used as liquid 50. As shown in FIG. 5(*g*), movement of liquid 50 to the side of the flow rate restricting portion due to occurrence of reverse flow at the time of application of the centrifugal force in the second direction was confirmed.

FIG. 6 represents pictures (FIGS. 6(*a*) to 6(*d*)) showing a moving route of liquid for the case where a microchip having the same structure as that of the microchip of the comparative example other than that recess 40 is formed in a surface of second substrate 2 facing a third groove of first substrate 1, and a perspective view (FIG. 6(*e*)) showing enlargement of portions in the microchip provided with first to fourth grooves. A plasma component is used as liquid 50. Recess 40 has an approximately cuboid shape (two surfaces are rounded), and its width (a distance from a side wall surface on a side of the flow rate restricting portion to a side wall surface on a side of the sample measuring portion) and depths are set to be 800 μm. A dimensional ratio of width and depth of each groove illustrated in FIG. 6(*e*) is approximately the same as those of one actually produced.

As shown in FIGS. 6(*a*) to 6(*d*), at the time of application of the centrifugal force in the second direction, liquid 50 does not reversely flow to the side of the flow rate restricting portion, and it moves along the second route. After conducting the same experiment repeatedly, it was confirmed that liquid 50 did not reversely flow but moved along the second route in most cases.

(2) Second Embodiment

Figure 7:
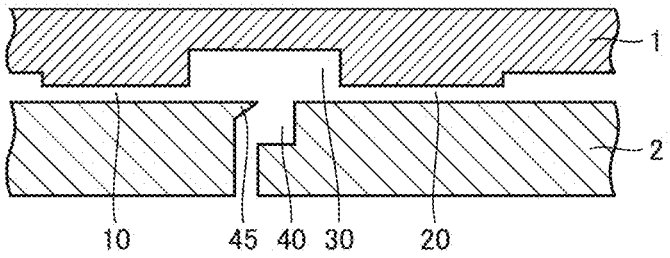
FIG. 7 is a cross-sectional view representing one example of a microchip according to a second embodiment.
Figure 8:
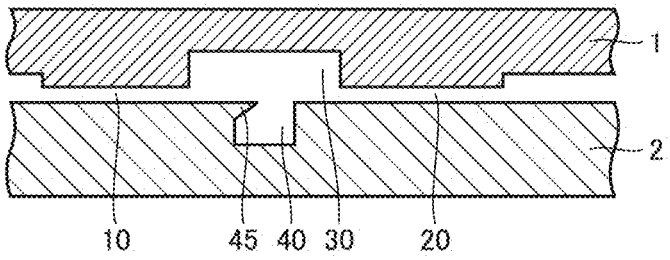
FIG. 8 is a cross-sectional view schematically representing another one example of the microchip according to the second embodiment.

FIGS. 7 and 8 are cross-sectional views schematically representing examples of the microchips according to the present embodiment. The microchips shown in FIGS. 7 and 8 basically have the same structure as that of the microchip according to the first embodiment other than that a protrusion 45 protruding from a side wall surface of recess 40 on a side of first groove 10 and having such a protrusion length of not allowing an end portion thereof to be in contact with a side wall surface (a side wall surface on a side of second groove 20). The difference between the microchips of FIG. 7 and the microchip of FIG. 8 is whether or not a cavity portion is formed directly under protrusion 45 depending on a manufacturing method of second substrate 2. The structure of the fluid circuit and the function of recess 40 are the same for both microchips. The microchips shown in FIGS. 7 and 8 are improved embodiments of the microchip shown in FIG. 1, and providing protrusion 45 is advantageous on the following points.

The microchip according to the first embodiment having recess 40 can effectively prevent movement of the liquid in the fluid circuit in the unintended direction, such as reverse flow phenomenon, so that fluid treatment as with intended design can be securely performed, as compared to the conventional microchips. However, in rare cases, when centrifugal force in the first direction is applied, the liquid sometimes take a moving route of moving from first groove 10 to a side of second groove 20 while going along the side wall surface and the bottom surface of recess 40 without going over recess 40. In such a case, the adhesion region due to protein and the like described above is not divided by recess 40, so that reverse flow has occurred at the time of applying centrifugal force in the second direction.

Providing protrusion 45 allows the liquid to be more assuredly moved while going over recess 40, so that the rare disadvantages as described above can be resolved. The experiment which is the same as described above was repeated for a hundred times or more for the microchip having the same structure as the microchip shown in FIG. 6 except for the provision of protrusion 45, but the disadvantage described above was not confirmed.

Figure 9:
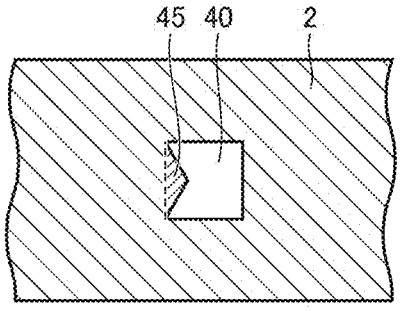
FIG. 9 is a top view schematically representing enlargement of a recess and a vicinity thereof.
Figure 10:
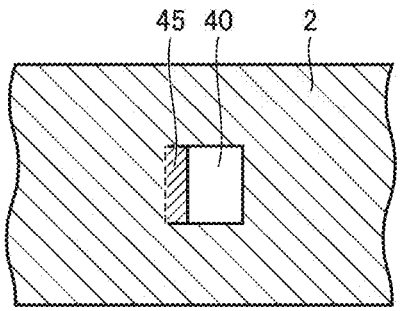
FIG. 10 is a top view schematically representing enlargement of a recess and a vicinity thereof.

FIGS. 9 and 10 are top views schematically representing recess 40 and its vicinity by enlargement, showing variations of the shapes of protrusion 45. As illustrated in these drawings, the shape of the protrusion viewed from above (direction perpendicular to the substrate surface) is not particularly limited, and may be a triangular shape (FIG. 9), a rectangular shape (FIG. 10), or the like. Preferably, it is a shape tapered toward the end portion (direction of second groove) as can be seen in FIG. 9, and more preferably a shape with an end portion facing the desired destination (in other words, direction of second groove 20). Such a tapered shape allows whole amount of liquid going over recess 40 to move toward the direction of second groove 20 more accurately.

A cross-sectional shape of protrusion 45 at a cross section R parallel to the direction in which protrusion 45 extends (a cross section which is parallel to the direction from first groove 10 to second groove 20 as shown in FIGS. 7 and 8) may also have various shapes such as a triangular shape or a rectangular shape as shown in FIGS. 7 and 8, and is preferably a triangular shape having an apex at an end portion of protrusion 45. With such a shape, a base point at the time when the liquid goes over to a side of second groove 20 can be converged to one point or one line. Thus, a whole amount of the liquid can be moved to the side of second groove 20 more assuredly.

The cross-sectional shape of protrusion 45 at a cross section S in the direction perpendicular to cross section R is not particularly limited, and it may have various shapes such as a triangular shape or a rectangular shape. In view of the above, the shape of protrusion 45 is preferably a tapered shape such as a four-sided pyramid or a three-sided pyramid having an apex at its end portion.

As to the depth direction (the depth direction of second substrate 2) in the side wall surface on a side of first groove 10 of recess 40, a position provided with protrusion 45 may be at any position, and is preferably provided at a position at which the surface of protrusion 45 on the side of first substrate 1 continues with another surface of second substrate 2 on the side of first substrate 1. When the surface of protrusion 45 on the side of first substrate 1 is provided thereunder (direction apart from first substrate 1), and there is a step between the surface of protrusion 45 on the side of first substrate 1 and the surface of second substrate 2 on the side of first substrate 1, there is a possibility that accuracy in moving whole amount of liquid is slightly lowered as compared to the case of being continuous.

Figure 11:
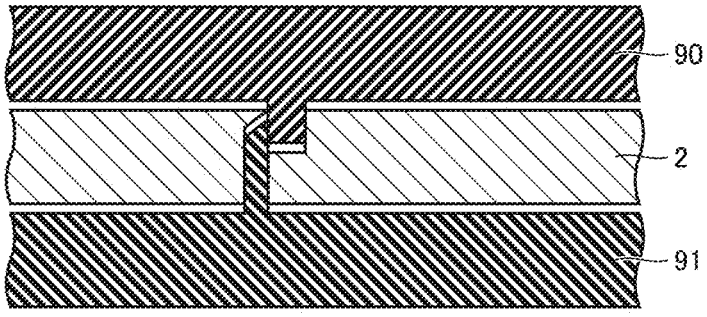
FIG. 11 is a cross-sectional view schematically representing production of a second substrate having a protrusion on a recess with use of a mold.

Protrusion 45 of recess 40 of second substrate 2 corresponds to so-called "undercut structure" in metallic molding process. Such second substrate 2 can be manufactured by applying molding from upper and lower sides of the substrate using a first die 90 and a second die 91 as shown in FIG. 11. In this case, resultant second substrate 2 has a cavity immediately under protrusion 45 as shown in FIG. 7. Other than such molding process, second substrate 2 having an undercut structure can also be manufactured by a slide-core method.

<Another Embodiment of Microchip of the Present Invention>

The microchip according to another embodiment of the present invention is provided with a fluid circuit including at least one or more measuring portion selected from a sample measuring portion and a liquid reagent measuring portion, and an overflow liquid storage and a liquid introducing portion corresponding thereto. The liquid introducing portion is a flow path partitioned by parts (chambers) or side walls provided immediately before the measuring portion (on upstream side of fluid treatment), and examples of the parts (chambers) include a flow rate restricting portion, a separation portion, a liquid reagent retaining portion, and the like. The measuring portion is spatially connected with the corresponding overflow liquid storage and liquid introducing portion.

The measuring portion is composed of a first space partitioned by a first wall (and a bottom surface of the groove and a surface of the substrate on a side of the first substrate facing the first substrate) which is a side wall of the groove of the first substrate. The liquid introducing portion is composed of a second space partitioned by a second wall (and a bottom surface of the groove and a surface of the substrate on a side of first substrate facing the first substrate) which is a side wall of the groove of the first substrate. The overflow liquid storage is composed of a third space partitioned by a third wall (and a bottom surface of the groove and a surface of the substrate on a side of first substrate facing the first substrate) of the groove of the first substrate.

The microchip according to another embodiment of the present invention, in a microchip having the measuring portion, sample measuring portion, and liquid reagent measuring portion as described above, has a structure portion described above for suppressing unintended movement of the liquid due to wettability with respect to a surface of the space connecting portion, and the structure portion is a structure in which the end portion of the second wall on the side of the first wall of the liquid introducing portion is spaced apart from the first wall of the measuring portion. Preferably, the structure portion is further spaced apart from the measuring portion of the third wall of the overflow liquid storage. According to such configuration, since the first wall forming the measuring portion and the side wall (second wall, more preferably the third wall) forming another adjacent part (the liquid introducing portion, more preferably the overflow liquid storage) are discontinuous, the measured liquid in the measuring portion can be prevented from flowing out of the measuring portion proceeding along the side wall surface of the groove forming the fluid circuit based on the tensional force due to the wettability there of the liquid, regardless of the kind of the measured sample. Accordingly, accurate measurement can be performed regardless of a kind of measured sample, so that fluctuation in test or analysis result due to the difference in a kind of sample can be prevented, and accuracy in test or analysis can also be improved.

The measuring portion may be a sample measuring portion, or a liquid reagent measuring portion, and preferably includes at least one sample measuring portion. This is because the sample measuring portion is a part for measuring a minute amount of liquid as compared to the liquid reagent measuring portion, and a relatively great fluctuation in amount of measured liquid occurs due to flowing out based on the tensional force of wettability.

Hereinafter, the microchip of the present invention will be described more in detail with reference to the embodiment.

(1) Third Embodiment

Figure 12:
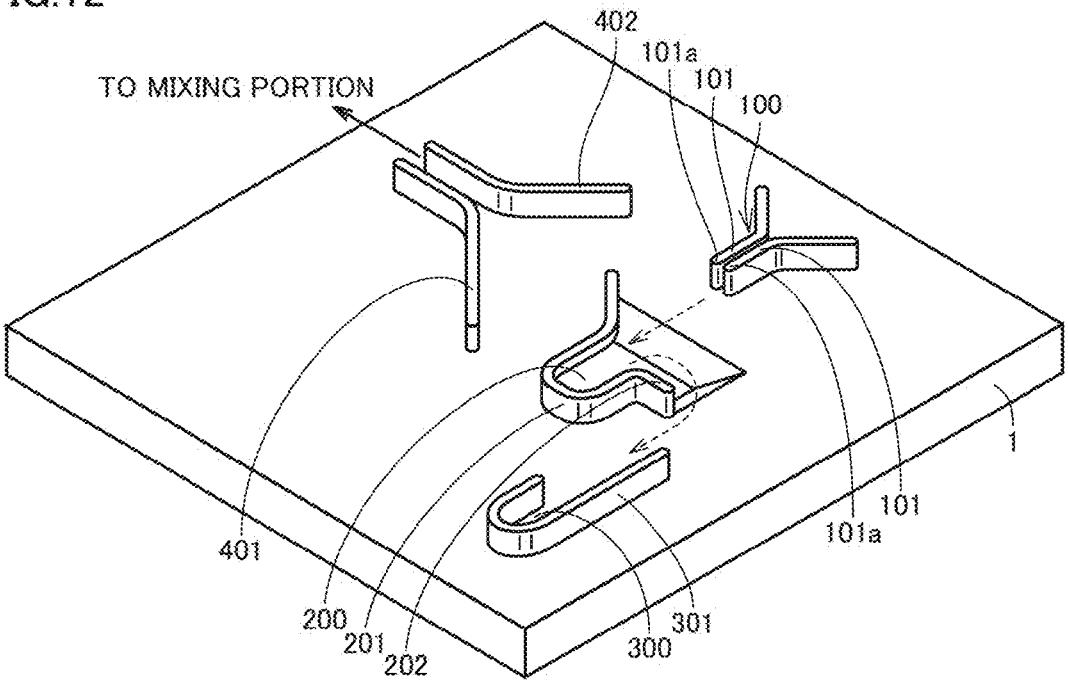
FIG. 12 is a perspective view schematically representing one example of a characterizing portion of a fluid circuit of a microchip according to a third embodiment.

FIG. 12 is a perspective view schematically representing one example of characterizing portions (measuring portion, liquid introducing portion, overflow liquid storage, and peripheral portion) of the fluid circuit of the microchip according to the present embodiment. The microchip shown in FIG. 12 is composed of first substrate 1, which is a transparent substrate, and a second substrate, which is an opaque substrate, stacked on and laminated with the surface on which the groove is formed. For clear understanding as to the configuration of the groove of first substrate 1 forming the characterizing portions of the fluid circuit, the second substrate is omitted in FIG. 12 (this applies similarly to FIGS. 13 and 17).

In the microchip shown in FIG. 12, the fluid circuit includes flow paths composed of: a liquid introducing portion 100 which is a flow rate restricting portion composed of a space (second space) partitioned by a pair of side walls 101, 101 (second wall) having two wall portions separated apart and facing each other; a measuring portion 200 which is a sample measuring portion arranged on downstream of liquid introducing portion 100 (region on down stream in fluid treatment and directly under liquid introducing portion 100) and composed of a space (first space) partitioned by a side wall (first wall) including a first wall portion 201 curved (approximately U-shaped) so as to have an opening for introducing the sample and a second wall portion 202 linearly extending outward (direction of an overflow liquid storage 300 opposite to the inside of the measuring portion) from one end (one end on the side of overflow liquid storage 300) of first wall portion 201; over flow liquid storage 300 arranged on a side of second wall portion 202 of measuring portion 200 and composed of a space (third space) partitioned by a side wall 301 (third wall) for accommodating excessive sample flowing out from measuring portion 200 when introducing the sample to measuring portion 200; and a space partitioned by a pair of side walls 401, 402 arranged on downstream of measuring portion 200 (region on downstream side in the fluid treatment and opposite side from overflow liquid storage 300) to introduce the measured sample in measuring portion 200 to a next part (for example, mixing portion).

As described above, the microchip shown in FIG. 12 is a microchip configured with two substrates, and having one-layer fluid circuit. Measuring portion 200, liquid introducing portion 100, and overflow liquid storage 300 are arranged in this one-layer fluid circuit. As variation of the present embodiment, the microchip has two-layer fluid circuit by stacking and laminating the second substrate, the first substrate, and the third substrate in this order. Measuring portion 200, liquid introducing portion 100, and overflow liquid storage 300 may be arranged in the first fluid circuit.

In the space connecting portion connecting the first space and the second space of the microchip shown in FIG. 12, end portions 101*a* of side walls 101 on a side of measuring portion 200 forming liquid introducing portion 100 are spaced apart from the side wall (first wall) forming measuring portion 200, and a side wall 301 (third wall) of overflow liquid storage 300 is also spaced apart from the side wall (first wall) forming measuring portion 200. Thus, when introducing a sample to measuring portion 200 by application of centrifugal force to the microchip to perform measurement, the measured sample in measuring portion 200 does not flow out to the side of liquid introducing portion 100 and the side of overflow liquid storage 300 by the tensional force due to its wettability and retained in measuring portion 200 also when the centrifugal force is temporarily stopped, for example, after the measurement, so that accurate measurement can be performed. All amount of the measured sample in measuring portion 200 can be moved, for example, to the mixing portion by the later application of the centrifugal force through flow paths partitioned by side walls 401, 402.

Figure 13:
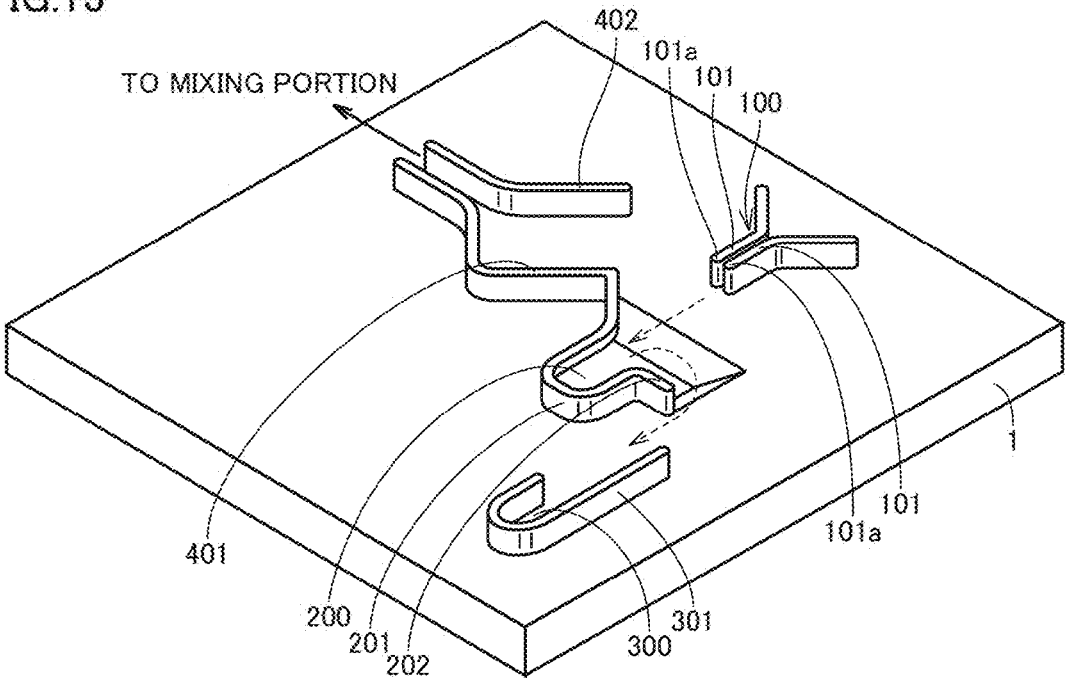
FIG. 13 is a perspective view schematically representing another one example of the characterizing portion of the fluid circuit of the microchip according to the third embodiment.

As shown in FIG. 13, the side wall forming measuring portion 200 may be not spaced apart from side wall 401 (this applies similarly in the embodiment described later). This is because movement of the measured sample in measuring portion 200 to the downstream direction by tensional force due to wettability does not have a negative influence on accuracy of test or analysis.

The shape of side wall 301 (third wall) of overflow liquid storage 300 is not particularly limited, and it is all necessary to have a shape including a curved wall portion which can accommodate the liquid (for example, other than the U-shape shown in FIG. 12, it may be V-shape or U-shape with rounded corners).

Figure 14:
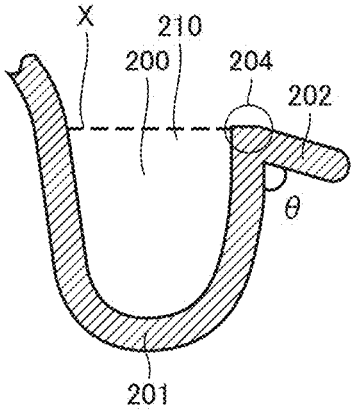
FIG. 14 represents enlargement of a side wall (first wall) forming the measuring portion shown in FIG. 12.

FIG. 14 represents enlargement of the side wall (first wall) forming measuring portion 200 shown in FIG. 12. As shown in FIG. 14, the first wall preferably includes first wall portion 201 curved so as to have an opening 210 for introducing a sample, and a second wall portion 202 extending linearly outward (direction of overflow liquid storage 300) from one end of overflow liquid storage 300 in first wall portion 201. In measuring portion 200 having such a shape, a liquid surface X of the measured sample occurs on a side wall surface (side wall surface portion on a side of liquid introducing portion 100 in region 204 shown in FIG. 14) at a connection position between first wall portion 201 and second wall portion 202.

When second wall portion 202 is provided, an end portion of the first wall forming measuring portion 200 (in other words, an end of the second wall portion on a side of overflow liquid storage 300) occurs at a position other than the side wall surface (the side wall surface at which liquid surface X of the measured sample occurs) at a connection position between first wall portion 201 and second wall portion 202. Such a configuration is advantageous on the following points. When the microchip is produced by laminating the substrates with each other, so-called "floating" occurs which causes an upper surface (or lower surface) on an end of the side wall forming the groove of the fluid circuit to be not sufficiently joined to the facing substrate. The floating often does not have a negative influence on test or analysis using the microchip. However, when the floating occurs in the measuring portion formed of the first wall having first wall portion 201 but not having second wall portion 202 (in other words, when the side wall surface at which the liquid surface of the measured liquid and the end of the first wall are aligned, and floating occurs on the side wall surface at which the liquid surface of the measured liquid occurs) a liquid surface of the measured liquid may occur at a position different from a designed liquid surface (normally, at a position of a liquid surface with a smaller amount than the amount that should be measured). By providing second wall portion 202, liquid can be accurately measured regardless of presence of floating.

An outer angle formed by first wall portion 201 and second wall portion 202 (θ in FIG. 14) may be dependent on a direction of the centrifugal force to be applied during measurement and an angle of arranging the measuring portion in the fluid circuit, but is generally 60 to 120 degrees, preferably is 75 to 105 degrees (for example, around 90 degrees) (θ is an angle which may take the range of 0 to 180 degrees).

In measuring portion 200, an area of a cross section (cross section at which liquid surface X occurs) in the direction perpendicular to the surface of first substrate 1 at opening 210 is preferably the smallest among areas of cross section in the direction the same as the space surrounded by curved first wall portion 201 (space constituting measuring portion 200). A cross-sectional area in opening 210 where liquid surface X occurs is set as small as possible, so that the error in measurement can be suppressed to be the smallest. The relationship of the cross-sectional area described above can be achieved by setting a position of the bottom surface of the groove in opening 210 to be higher than a position of the bottom surface of the groove at other portions (in other words, set a depth of the groove to be smaller).

The shape of the side wall forming liquid introducing portion 100, which is the flow rate restricting portion, is not limited to the shape shown in FIG. 12, and is all necessary to have a pair of linear (straight line or curved line, for example) wall portions spaced apart and arranged so as to face each other. To provide the function of the flow rate restricting portion, the distance between the pair of wall portions is typically set to be 10 to 1000 μm, preferably 50 to 200 μm.

Figure 15:
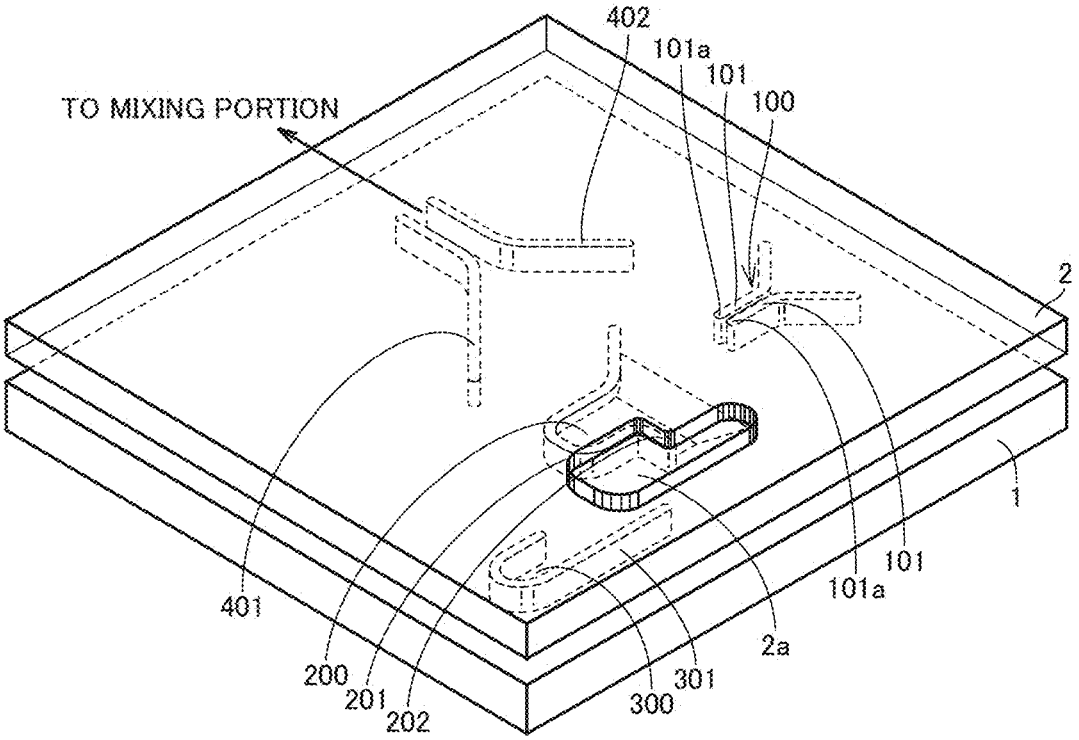
FIG. 15 is a perspective view schematically representing another one example of the characterizing portion of the fluid circuit of the microchip according to the third embodiment.

FIG. 15 is a perspective view schematically representing another one example of characterizing portions of the fluid circuit of the microchip according to the present embodiment. In FIG. 15, the shape of the groove forming the fluid circuit of first substrate 1 (shape of the walls) is the same as FIG. 12. The microchip of FIG. 15 is the same as the microchip of FIG. 12, other than using the substrate having a recess 2*a* on a surface on a side of first substrate 1 as second substrate 2. Recess 2*a* is provided at an outlet of measuring portion 200 on a side of second wall portion 202 or its vicinity, and at a position immediately above a part of first wall portion 201 on a side of overflow liquid storage 300 and the region adjacent to the outer side of second wall portion 202. By providing such recess 2*a*, a step is formed on an inner wall of the fluid circuit. Therefore, the measured liquid in the measuring portion can be effectively prevented from unintentionally flowing out (in this example, flowing out to the side of overflow liquid storage 300).

(2) Fourth Embodiment

Figure 16A:
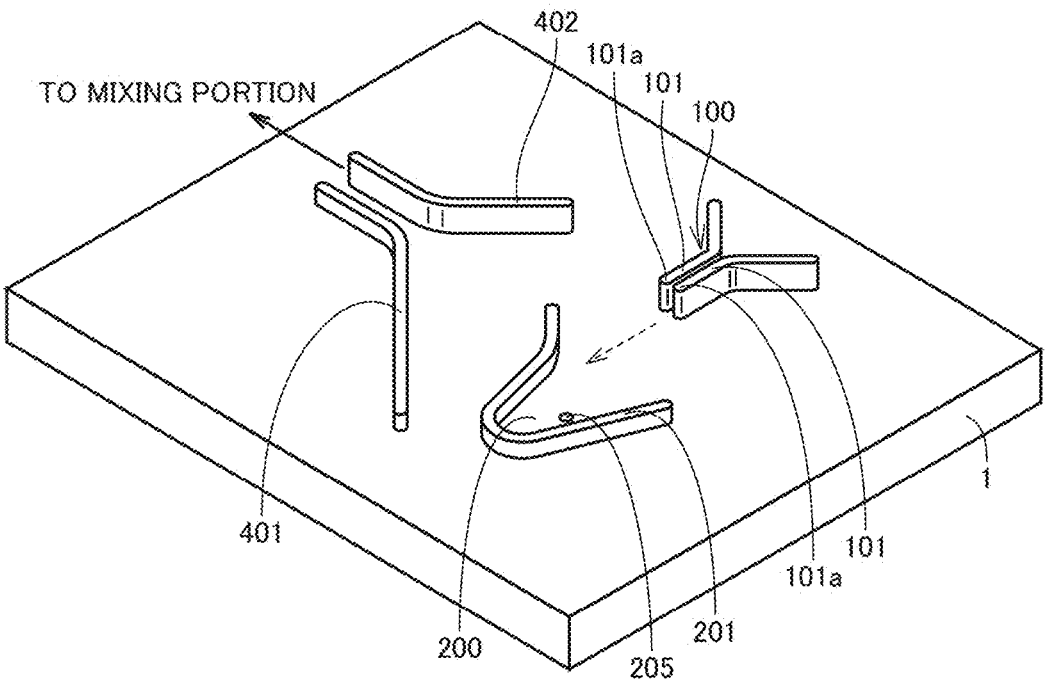
FIG. 16A is a perspective view schematically representing one example of a characterizing portion of a fluid circuit of a microchip according to a fourth embodiment.
Figure 16B:
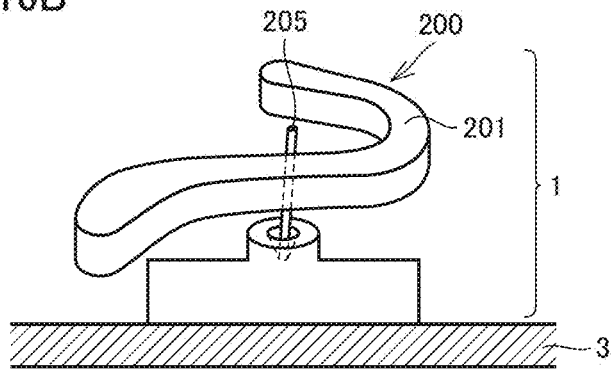
FIG. 16B is a cross-sectional view schematically representing a vicinity of the measuring portion shown in FIG. 16A.

FIGS. 16A and 16B are perspective views schematically representing one example of the characterizing portions of the fluid circuit of the microchip according to the present embodiment. The microchip shown in FIGS. 16A and 16B is configured with first substrate 1, which is an opaque substrate having grooves on both of opposite surfaces, and a second substrate, which is a transparent substrate stacked on one surface of first substrate 1, and a third substrate 3, which is a transparent substrate stacked on the other surface of first substrate 1. It should be noted that the second substrate and third substrate 3 are omitted from FIG. 16A (this applies similarly to FIG. 18 which will be described later), and the second substrate is omitted from FIG. 16B for clear understanding of the configuration of the groove of first substrate 1 forming the characterizing portions of the fluid circuit.

The microchip shown in FIGS. 16A and 16B has a structure different from the third embodiment described above in that two-layer fluid circuit is formed by stacking and laminating the second substrate, first substrate 1, and third substrate 3 in this order, and measuring portion 200 and liquid introducing portion 100, which is a flow rate restricting portion, are arranged in the first fluid circuit (fluid circuit shown in FIG. 16A) formed by the groove of first substrate 1 and a surface of the second substrate on a side of first substrate 1, and the overflow liquid storage is arranged in the second fluid circuit formed by the groove of first substrate 1 and a surface of third substrate 3 on a side of the first substrate 1.

Measuring portion 200 in the first fluid circuit and the overflow liquid storage in the second fluid circuit are spatially connected through hole 205 penetrating through first substrate 1 in the thickness direction provided in the groove bottom surface forming measuring portion 200 (the groove bottom surface of the space surrounded by first wall portion 201 curved so as to have an opening). Specifically, an end portion of through hole 205 on a side of third substrate 3 can be directly connected to the space forming the overflow liquid storage or can be coupled to the space forming the flow path coupled to the overflow liquid storage.

As described above, in the present embodiment, the overflow liquid storage is arranged in the second fluid circuit, and measuring portion 200 and the overflow liquid storage are connected spatially by through hole 205, so that the configuration is achieved which has a side wall (first wall) forming measuring portion 200 spaced apart from the side wall (third wall) forming the overflow liquid storage. Therefore, also in the present embodiment, the effect same as that of the third embodiment can be obtained.

The position of providing through hole 205 is in the space surrounded by curved first wall portion 201, and at a position capable of measuring a desired amount of liquid. In measuring portion 200 having through hole 205, the excessive liquid overflowing from measuring portion 200 at the time of measurement passes through hole 205, and is accommodated in the overflow liquid storage in the second fluid circuit, so that a liquid surface of the measured liquid occurs on through hole 205 (more accurately, along the lower end of through hole 205).

In the present embodiment, the shape of the side wall (first wall) forming measuring portion 200 may be the same as that of the third embodiment. However, it is not always necessary to provide the second wall portion as described in the third embodiment since the liquid surface of the measured liquid does not occur at an end portion of the first wall in measuring portion 200 having through hole 205 in the space surrounded by curved first wall portion 201.

The shape of the side wall (third wall) of the overflow liquid storage is not particularly limited, and is all necessary to have a shape including a curved wall portion (for example, the shape of U-shape, V-shape, and U-shape with right angle corners) capable of accommodating the liquid.

(3) Fifth Embodiment

Figure 17:
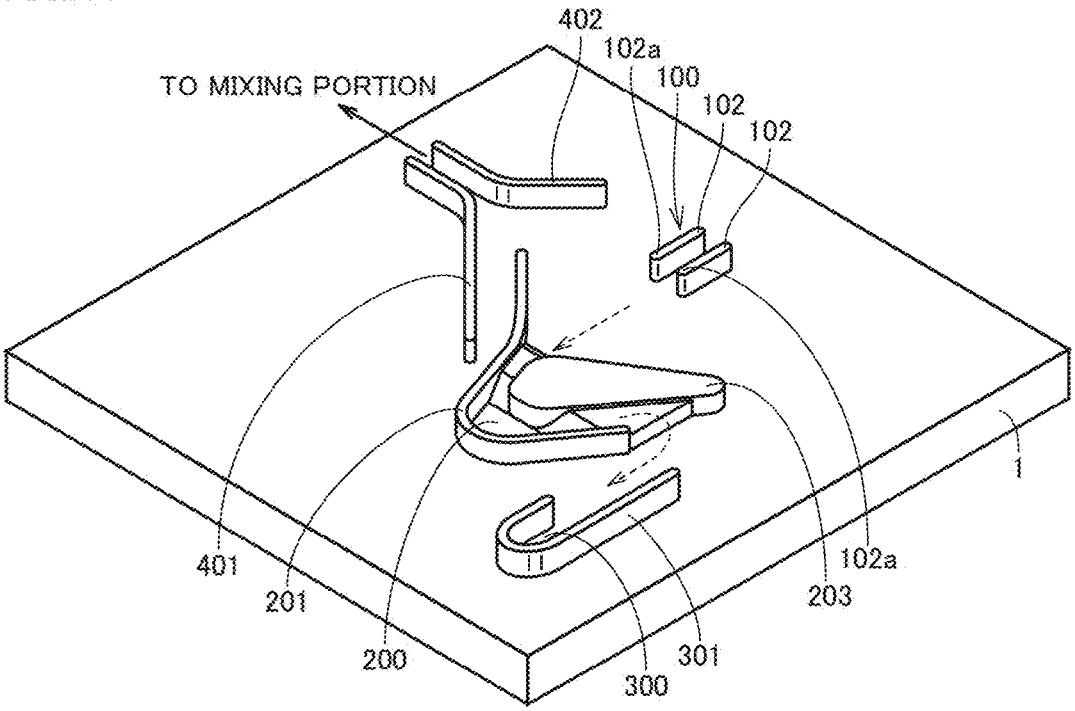
FIG. 17 is a perspective view schematically representing one example of a characterizing portion of a fluid circuit of a microchip according to a fifth embodiment.

FIG. 17 represents a perspective view schematically showing one example of the characterizing portions of the fluid circuit of the microchip according to the present embodiment. The microchip shown in FIG. 17 has a configuration which is the same as the third embodiment, other than that, 1) liquid introducing portion 100 is a flow path composed of a space (second space) partitioned by a pair of side walls 102, 102 (second walls) arranged so as to face each other, and that 2) the side wall (first wall) forming measuring portion 200, which is the sample measuring portion, includes (approximately U-shaped) first wall portion 201 curved so as to have an opening and side wall portion 203 arranged so as to divide the opening into two parts.

In other words, in the present embodiment, measuring portion 200 is formed to have an approximately V-shape by side wall portion 203, and being different from the third embodiment, distinguishes an opening for introducing and accepting the sample from liquid introducing portion 100 and an opening for discharging excessive liquid overflew at the time of measurement to the side of overflow liquid storage 300. As described above, in the case of distinguishing the opening for accepting and the opening for discharging, the sample can be accepted from one opening while discharging air from the other opening, so that it is not always necessary to adjust a flow rate and a liquid width of the sample in liquid introducing portion 100. Thus, liquid introducing portion 100 may be not flow rate restricting portion. In the present embodiment, liquid introducing portion 100 can be a part on a side of measuring portion 200 in the flow rate restricting portion, the separation portion, or the liquid reagent retaining portion or a flow path partitioned by the side wall.

The microchip shown in FIG. 17 is the same as the third embodiment in that, end portions 102*a* of side wall 102 on a side of measuring portion 200 forming liquid introducing portion 100 is separated apart from the side wall (first wall) forming measuring portion 200, and side wall 301 (third wall) of overflow liquid storage 300 is separated from the side wall (first wall) forming measuring portion 200. Therefore, the effect which is the same as that of the third embodiment can be obtained also in the present embodiment.

(4) Sixth Embodiment

Figure 18:
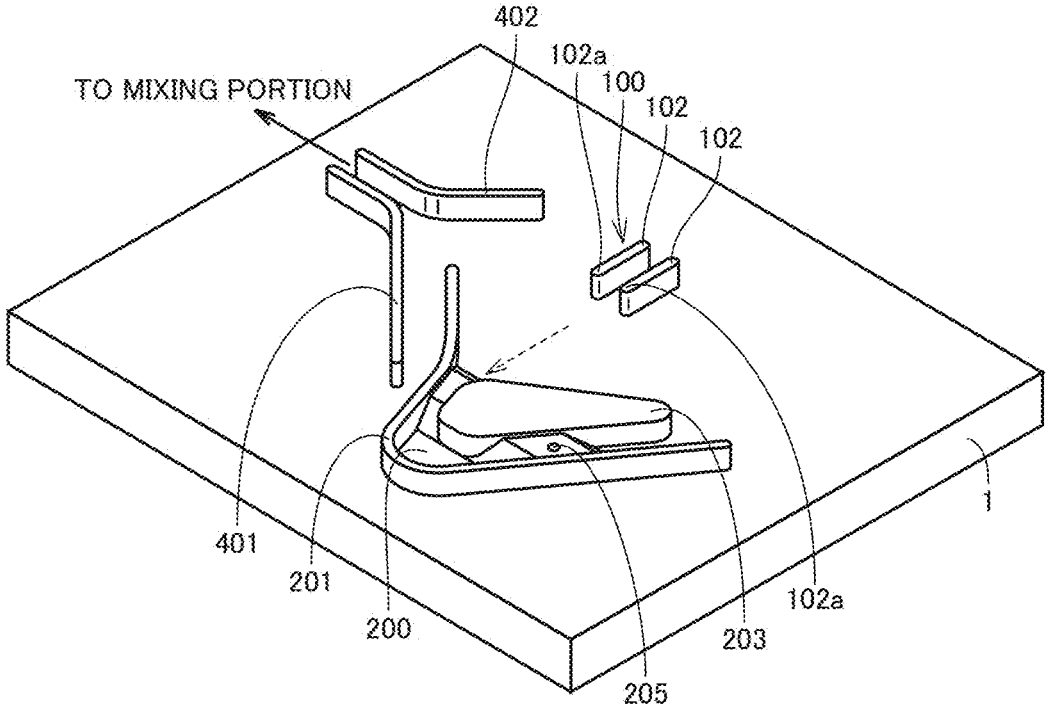
FIG. 18 is a perspective view schematically representing one example of a characterizing portion of a fluid circuit of a microchip according to a sixth embodiment.

FIG. 18 is a perspective view schematically representing one example of the characterizing portions of the fluid circuit of the microchip according to the present embodiment. The microchip of the present embodiment shown in FIG. 18 has the same configuration as the fourth embodiment other than that liquid introducing portion 100 and measuring portion 200 have the configuration described in the fifth embodiment. The same effect as the third embodiment can be achieved also with the present embodiment.

EXAMPLES

Hereinafter, an example and a comparative Example will be presented to describe the present invention more specifically. However, the present invention is not limited to the examples.

Example 1 and Comparative Example 1

Figure 19:
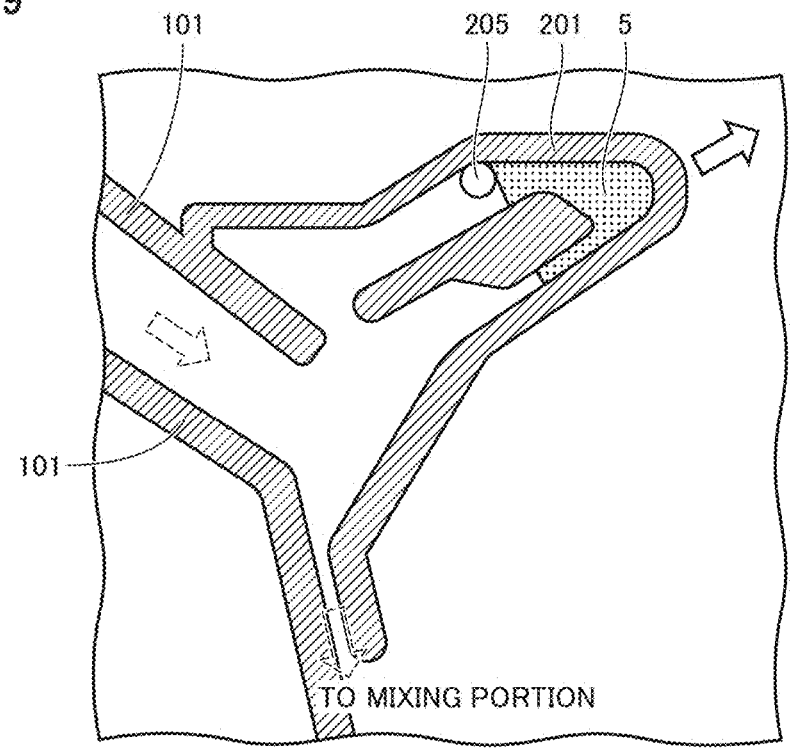
FIG. 19 is a top view schematically representing a characterizing portion of a fluid circuit of a microchip produced in Example 1.
Figure 20:
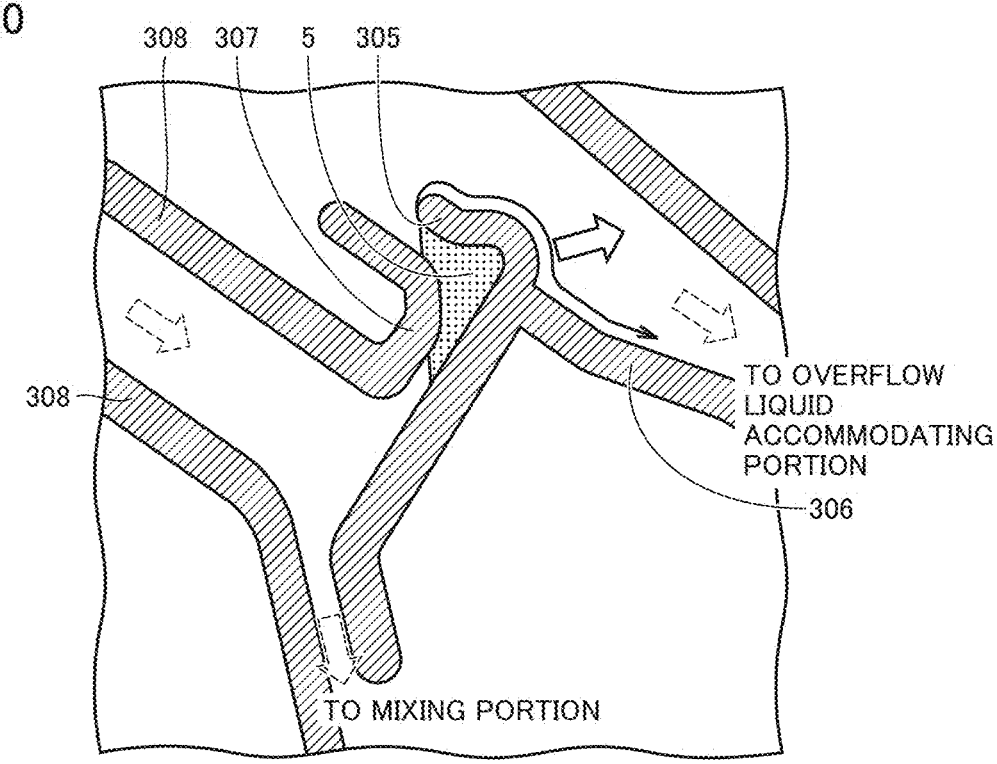
FIG. 20 is a top view schematically representing a characterizing portion of a fluid circuit of a microchip produced in Comparative Example 1.
Figure 21:
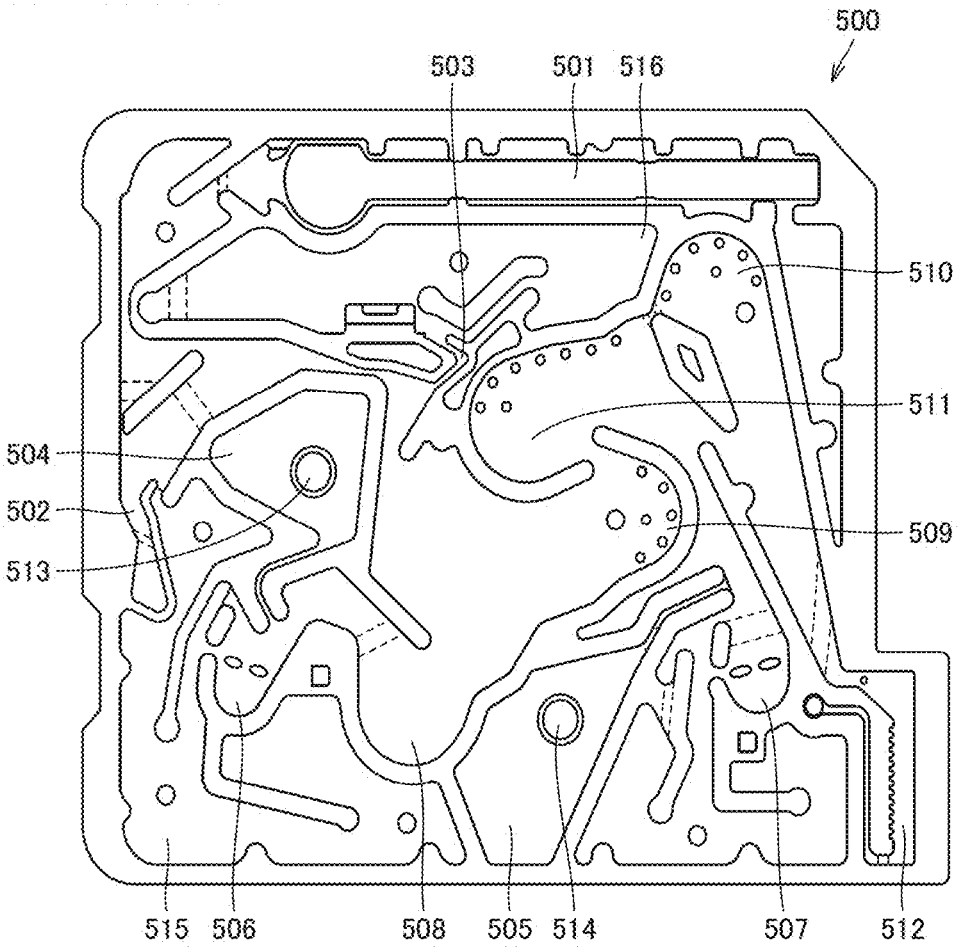
FIG.21 PRIOR ART
FIG. 21 is a top view representing one example of a fluid circuit structure of a conventional microchip.

FIGS. 19 and 20 are top views schematically representing characterizing portions (measuring portion, liquid introducing portion, and overflow liquid storage) of the fluid circuit of the microchips produced in Example 1 and Comparative Example 1. The microchip shown in FIG. 19 (Example 1) is a microchip having the configuration which is the same as that of FIG. 18 with a two-layer fluid circuit formed by stacking and laminating the second substrate, first substrate, and third substrate in this order, and in which the measuring portion and liquid introducing portion are arranged in the first fluid circuit formed by the groove of the first substrate and the surface of the second substrate on a side of the first substrate, and the over flow liquid storage is arranged in the second fluid circuit formed of the groove of the first substrate and the surface of the third substrate on a side of the first substrate. It should be noted that the second substrate and third substrate are omitted in FIG. 19 so that the configuration of the groove of the first substrate forming the characterizing portion of the fluid circuit can be clearly understood.

The measuring portion and the overflow liquid storage are spatially connected via through hole 205 penetrating through the first substrate in the thickness direction provided on the groove bottom surface (the groove bottom surface of the space surrounded by first wall portion 201 curved so as to have an opening) forming the measuring portion. In the microchip shown in FIG. 19, the liquid introducing portion is formed of a pair of side walls (second wall) 101, 101 spaced apart and arranged so as to face each other.

On the other hand, the microchip shown in FIG. 20 (Comparative Example 1) is a microchip configured with two substrates with the first and second substrates and provided with one-layer fluid circuit. The measuring portion, liquid introducing portion, and overflow liquid storage are arranged in this one-layer fluid circuit. The measuring portion has a flow path which is composed of a space partitioned by side walls 305 and 307 including a portion curved to be an approximately U-shape, extending from side wall 305, as a space partitioned by side wall 306 continuous with side wall 305, and reaching the overflow liquid storage. Thus, the side wall forming the measuring portion and the side wall forming the overflow liquid storage are continuous. In the microchip shown in FIG. 20, the liquid introducing portion is formed of a pair of side walls (second walls) 308, 308 spaced apart and arranged so as to face each other, and its end portion and side wall 307 forming the measuring portion are continuous.

The microchips of Example 1 and Comparative Example 1 have a substantially the same configuration except for the configuration of the characterizing portions, and both the fluid circuits thereof include the separation portion, liquid reagent retaining portion, mixing portion, detection portion, and the like.

The following evaluation experiment was conducted for the microchips of Example 1 and Comparative Example 1. After the centrifugal force in the directions indicated by white-out arrows shown in FIGS. 19 and 20 is applied to the microchip to move a sample 5 to pass through the liquid introducing portion (refer to the dotted line arrow in the liquid introducing portion), and sample 5 is thereafter introduced into the measuring portion to measure sample 5. In the microchip of Example 1, excessive sample 5 flowing out from the measuring portion at the time of measurement passes through the through hole 205 to be accommodated in the overflow liquid storage of the second fluid circuit. In the microchip of Comparative Example 1, excessive sample 5 is accommodated in the overflow liquid storage through the flow path partitioned by side wall 306 (refer to the dotted line arrow near side wall 306). FIGS. 19 and 20 show the state after the measurement where sample 5 is filled in the measuring portion.

Using a plasma component and serum as sample 5 to be introduced into the measuring portion, ten microchips are used for each sample to conduct fluid treatment for ten times, and then creatine kinase (CK) value (unit: U/L) for the liquid mixture introduced into the detection portion was measured for each sample. The result is shown in Table 1.

TABLE 1

| | Example 1 | | Comparative Example 1 | |
|---|---|---|---|---|
| | Plasma Component | Serum | Plasma Component | Serum |
| 1 | 159 | 156 | 120 | 125 |
| 2 | 152 | 150 | 108 | 126 |
| 3 | 156 | 157 | 111 | 121 |
| 4 | 152 | 148 | 104 | 127 |
| 5 | 156 | 151 | 124 | 135 |
| 6 | 158 | 158 | 125 | 128 |
| 7 | 150 | 152 | 113 | 126 |
| 8 | 155 | 146 | 119 | 118 |
| 9 | 145 | 153 | 107 | 130 |
| 10 | 149 | 156 | 112 | 141 |
| Average | 153 | 153 | 114 | 128 |
| σ | 4.4 | 4.2 | 7.2 | 6.6 |
| CV value (%) | 2.9 | 2.7 | 6.3 | 5.2 |
| Plasma/Serum | 1.00 | | 0.90 | |

As shown in Table 1, in the microchip of Example 1, the "Plasma/Serum" value (average value of the CK value for the case where the plasma component is used/average value of the CK value for the case where the serum is used) was 1.00. As can be seen, it was found that, according to the microchip of Example 1, the same measurement result can be obtained with the plasma component and the serum. Further, it could be found that the measurement accuracy itself can be also improved since the CV value has improved from 5.2-6.3% of Comparative Example 1 to 2.7-2.9%.

On the other hand, the microchip of Comparative Example 1 has a large difference in the measurement result between the case where sample 5 is a plasma component and the case where sample 5 is serum, and the measurement accuracy is also lower as compared to the microchip of Example 1. This is because of the following reasons. In other words, when excessive sample 5 moves from the measurement portion to the overflow liquid storage at the time of measurement, a small amount of sample 5 adheres to the side wall of the passage. Then, wettability with respect to the side wall at which the sample 5 adheres is higher in the case where sample 5 is a plasma component. Thus, the amount of sample 5 moving along the side wall by the tensional force due to wettability to the direction of the overflow liquid storage from the measuring portion as shown in FIG. 20 with the solid line arrow when the application of centrifugal force with respect to the microchip is stopped after the measurement becomes larger when the sample 5 is a plasma component. Accordingly, the difference in the measurement results between the case where sample 5 is a plasma component and the case where sample 5 is serum becomes greater, and the measurement accuracy is also lowered. Flowing of measured sample 5 in the measuring portion to the side of liquid introducing portion by the tensional force due to wettability may also cause the difference in the measurement results between the case where sample 5 is a plasma component and the case where sample 5 is serum, and lowering in the measurement accuracy.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A microchip comprising a fluid circuit composed of a space formed inside, said space including a first space, a second space, and a space connecting portion connecting the first space and the second space, said space connecting portion having a structure portion for restraining liquid moving between the first space and the second space from moving due to wettability of the liquid with respect to a surface of said space connecting portion, the microchip further comprising a first substrate having on a surface thereof a groove forming said space, and a second substrate stacked on a surface of said first substrate on a side having said groove, wherein said groove of said first substrate includes a first groove forming said first space, a second groove forming said second space, and a third groove forming said space connecting portion, said third groove is a groove coupling the first groove and the second groove, and has a larger base area than said first groove and said second groove, and said second substrate has a recess as said structure portion on a surface on the side of said first substrate and at a position facing said third groove, the microchip further comprising a protrusion protruding from a side wall surface of said recess on a side of said first groove and having a protrusion length such that an end portion of said protrusion does not come in contact with an opposite side wall surface.

2. The microchip according to claim 1, wherein said protrusion is arranged such that a surface of said protrusion on a side of said first substrate continues with a surface of said second substrate.

3. The microchip according to claim 1, wherein said protrusion has a shape which is tapered toward said end portion.

4. A microchip comprising a fluid circuit composed of a space formed inside, said space including a first space, a second space, and a space connecting portion connecting the first space and the second space, said space connecting portion having a structure portion for restraining liquid moving between the first space and the second space from moving due to wettability of the liquid with respect to a surface of said space connecting portion, the microchip further comprising a first substrate having on a surface thereof a groove forming said space, and a second substrate stacked on a surface of said first substrate on a side having said groove, wherein said groove of said first substrate includes a first groove forming said first space, a second groove forming said second space, and a third groove forming said space connecting portion, said third groove is a groove coupling the first groove and the second groove, and has a larger base area than said first groove and said second groove, said second substrate has a recess as said structure portion on a surface on the side of said first substrate and at a position facing said third groove, and a base area of said recess is smaller than a base area of said third groove.

5. The microchip according to claim 1, wherein said recess is arranged so as to be within a surface region of said second substrate facing a surface region of said first substrate in which said third groove is formed.

6. The microchip according to claim 4, wherein said first groove, said second groove, and said third groove are aligned linearly.

7. The microchip according to claim 4, wherein said second groove is a groove forming a measuring portion for measuring a sample.

8. The microchip according to claim 4, wherein said groove of said first substrate further includes a fourth groove coupled to said third groove at a position different from the position at which said first groove and said second groove are coupled.

9. A microchip comprising a fluid circuit composed of a space formed inside, said space including a first space, a second space, and a space connecting portion connecting the first space and the second space, said space connecting portion having a structure portion for restraining liquid moving between the first space and the second space from moving due to wettability of the liquid with respect to a surface of said space connecting portion, wherein said fluid circuit includes:

a measuring portion for measuring liquid, said measuring portion being said first space partitioned by a first wall; and a liquid introducing portion spatially connected with said measuring portion, said liquid introducing portion being said second space partitioned by a second wall, and said structure portion is a structure in which an end of said second wall on a side of said first wall is spaced apart from said first wall, wherein said first wall includes a first wall portion curved so as to have an opening for introducing said liquid.

10. The microchip according to claim 9, wherein said fluid circuit further includes an overflow liquid storage for storing excessive liquid flowing out from said measuring portion when said liquid is introduced into said measuring portion, said overflow liquid storage being composed of a third space partitioned by a third wall and being spatially connected to said measuring portion, and said third wall is spaced apart from said first wall.

11. The microchip according to claim 10, further comprising:

a first substrate having a first groove on a first surface of the first substrate and having a second groove on a second opposite surface of the first substrate, a second substrate stacked on the first surface of said first substrate, and a third substrate stacked on the second surface of said first substrate, wherein said fluid circuit is composed of a first fluid circuit formed by the first groove of said first substrate and a surface of said second substrate on a first side of said first substrate, and a second fluid circuit formed by the second groove of said first substrate and a surface of said third substrate on a second side of said first substrate, and said first fluid circuit includes said measuring portion, and said second fluid circuit includes said overflow liquid storage portion, and a through hole penetrating through said first substrate in a thickness direction is formed in a groove bottom surface forming said measuring portion.

12. The microchip according to claim 9, further comprising a first substrate having a groove on a surface thereof, and a second substrate stacked on the surface of said first substrate on a side having said groove, wherein said fluid circuit is composed of a space formed by the groove of said first substrate and a surface of said second substrate on a side of said first substrate.

13. The microchip according to claim 10, further comprising a first substrate having grooves on both of opposite surfaces thereof, a second substrate stacked on one surface of said first substrate, and a third substrate stacked on other surface of said first substrate, wherein said fluid circuit is composed of a first fluid circuit formed by the groove of said first substrate and a surface of said second substrate on a side of said first substrate, and a second fluid circuit formed by the groove of said first substrate and a surface of said third substrate on a side of said first substrate, and said first fluid circuit includes said measuring portion and said overflow liquid storage.

14. The microchip according to claim 9, wherein a cross-sectional area of said first space in said opening is the smallest among cross-sectional areas of spaces surrounded by said first wall portion.

15. The microchip according to claim 9, wherein said second wall portion extends linearly outward from one end of said first wall portion.

16. The microchip according to claim 9, wherein said second wall includes two linear walls arranged so as to face with each other.

* * * * *